US006702461B2

(12) United States Patent
Vangedal-Nielsen

(10) Patent No.: US 6,702,461 B2
(45) Date of Patent: Mar. 9, 2004

(54) BAG FOR STORING A PRODUCT

(75) Inventor: Erling Vangedal-Nielsen, Vedbæk (DK)

(73) Assignee: Schur Consumer Products A/S, Vejle (DK)

( * ) Notice: Subject to any disclaimer, the term of this patent is extended or adjusted under 35 U.S.C. 154(b) by 0 days.

(21) Appl. No.: 10/164,849

(22) Filed: Jun. 6, 2002

(65) Prior Publication Data

US 2003/0059128 A1 Mar. 27, 2003

Related U.S. Application Data

(63) Continuation of application No. PCT/DK00/00685, filed on Dec. 8, 2000.

(30) Foreign Application Priority Data

Dec. 9, 1999 (EP) ..... 99610078

(51) Int. Cl.[7] ..... B65D 30/22
(52) U.S. Cl. ..... 383/38; 383/66; 210/464
(58) Field of Search ..... 383/38, 100, 101, 383/66; 210/464

(56) References Cited

U.S. PATENT DOCUMENTS 4,715,963 A * 12/1987 Jones ..... 210/781
5,380,093 A * 1/1995 Goldman ..... 383/38
5,701,996 A * 12/1997 Goto et al. ..... 206/287
6,200,027 B1 * 3/2001 Jones ..... 383/40

FOREIGN PATENT DOCUMENTS

| | | | | |
|---|---|---|---|---|
| EP | 0275350 | * | 7/1988 | 383/38 |
| FR | 1170658 | * | 1/1959 | 383/100 |
| GB | 0926657 | * | 5/1963 | 383/100 |
| JP | 405278751 A | * | 10/1993 | 383/100 |

* cited by examiner

*Primary Examiner*—Jes F. Pascua
(74) *Attorney, Agent, or Firm*—Klein, O'Neill & Singh, LLP

(57) ABSTRACT

A multipurpose bag is formed of two plastic foil layers joined together to define a top, a bottom, and opposing sides. Peripheral joints between the layers extend along the bottom and the sides to define an inner chamber, the joint along one of the sides being divided by an unjoined area into top and bottom parts. A separation joint extends from the top part of the divided side peripheral joint toward the bottom peripheral joint, dividing the chamber into top and bottom chambers. The top defines a top opening communicating with the top chamber, and the unjoined area defines a side opening communicating with the bottom chamber. The separation joint restricts communication between the top and bottom chambers for preventing a solid product in the top chamber from passing into the bottom chamber, while allowing liquid to pass from the top chamber to the bottom chamber. Liquid may then be expelled from the bottom chamber through the side opening.

19 Claims, 17 Drawing Sheets

BAG FOR STORING A PRODUCT

CROSS-REFERENCE TO RELATED APPLICATION

This application is a Continuation of International Application No. PCT/DK00/00685; filed Dec. 8, 2000.

FEDERALLY SPONSORED RESEARCH OR DEVELOPMENT

Not Applicable

BACKGROUND OF THE INVENTION

The present invention relates to a flexible multipurpose convenience bag for storing a product, such as a food product, for allowing said product to be cleaned or rinsed by pouring water into said bag, and/or for blanching, boiling, cooking, frying etc. said product.

From published international patent application WO96/13440 corresponding to U.S. Pat. No. 5,380,093 a bag is known. Reference is made to the above published patent application and the above US patent is further hereby incorporated in the present specification by reference.

According to the above-mentioned US patent and published international patent application, a vegetable draining and storage bag of the above-mentioned type is known which bag is produced from two foil sheets of rectangular configuration which sheets are joined together, e.g. through weldings, along the bottom and the two opposite side edges of the bag. A further weld is established extending from a position above the bottom of the bag parallel with one of the edge welds of the bag for providing a tubular channel establishing communication between a separator chamber defined at the bottom of the bag through a number of weld seams defining apertures and separating the bottom separator chamber from the major inner chamber of the bag constituting a chamber for receiving the product such as the food product.

The bag is used by arranging the product such as the food product within the major inner chamber of the bag and pouring water onto the product causing the water to flow from the major inner chamber to the separator chamber from which chamber the water may be expelled by tilting the bag to the one side and causing the water to be expelled through the tubular channel extending from the bottom of the bag to the top of the bag along one of the edges of the bag. After the rinsing of the product and expelling of the water from the bag, the product contained within the bag may be further dried by swinging the bag around causing the product contained within the bag to exposure to a high centrifugal force causing the water to be slung off the product and forced into the bottom separator chamber from which the water may be expelled through the tubular channel.

Although this prior art bag has turned out to be successful and allows the user to clean e.g. vegetables in a low cost disposable bag and in a centrifugal separation process dry the vegetable products by centrifugal separating the water droplets from the product and thereafter expel the excess water through the outlet tube along the one edge of the bag, the bag has turned out to be on the one hand limited as to its functionality and on the other hand requires the use of a fairly large amount of foil material for providing a container for the storing of the product such as a food product. It has turned out that the commercial version of the product, 20% of the foil material is used for establishing the separator chamber and the tubular channel. Further as far as the functionality of the bag is concerned, the bag can apart from storing a product only be used in the above-described one operation involving the filling of the bag with water to a certain extent and then expelling the water before carrying out the centrifugal separation, however in certain instances, the amount of water which is receivable within the bag is not capable of establishing a complete cleaning or rinsing of the product contained within the bag therefore necessitating the repetition of the process of first filling the water into the bag, manipulating the product within the bag and expelling the water from the bag and then repeating the filling of water into the bag, manipulating and expelling steps several time.

SUMMARY OF THE INVENTION

An object of the present invention is to provide a multipurpose convenience bag of the above-mentioned type which bag allows for on the one hand a more efficient utilisation of the foil material still providing a multipurpose convenience bag and on the other hand allows for additional functionalities including the possibility of performing a continuous or long lasting rinsing operation without repeating steps involving filling, manipulating, expelling and refilling etc. and further allowing the bag to be used for preparing the product, e.g. by blanching, boiling, cooking, frying etc. the product, while the product is contained within the bag.

A particular advantage of the present invention relates to the fact that the multipurpose convenience bag according to the present invention may be used in a rinsing process allowing the user to carry out the rinsing operation continuously without necessitating rearranging the bag, closing off the water supply and expelling water.

A further advantage of the present invention relates to the fact that the multipurpose convenience bag according to the present invention may be used for additional purposes apart from allowing the product contained in or stored in the bag to be rinsed further allowing the product to be prepared e.g. in a blanching, a boiling, a cooking or a frying operation which may be carried out after the bag has been used for storing purpose exclusively or alternatively after the bag has been used for the storage and rinsing purposes. The product which may be stored, rinsed and/or prepared in the bag may as pointed out above be constituted by vegetable or meat products including without being limited to the below examples potatoes, spinach, cabbage types including cauliflower, sprouts, cabbage, red cabbage, spring cabbage, mushrooms, carrots, celery, leeks, broccoli, pork, turkey, beef, chicken, duck, lamb etc., the product or products in question being present in their entity or in chopped or particulate state.

A further feature of the present invention relates to the fact that the multipurpose convenience bag according to the present invention may be converted from a bag of the above described type into a sieve or strainer structure or alternatively in specific embodiments of the bag according to the present invention be converted into a two step sieve or strainer structure allowing the user to utilise the bag for a separation process in which the product is separated into coarse and finer constituents.

The above object, the above advantages and the above feature are along with numerous other objects, features and advantages which will be evident from the below detailed description of preferred embodiments of the present invention be obtained by a multipurpose convenience bag according to the present invention comprising:

two sheet-shaped foil layers having substantially identical geometrical configurations and arranged in substantially coplanar and coextensive relationship, the foil layers together defining an outer periphery including a top, a bottom and opposite sides, a first peripheral joint extending along the bottom, second peripheral joints extending along the major parts of the sides except for at least one area of one of the sides, the area dividing the second peripheral joint of the one side into a top part and a bottom part, the first peripheral joint and the second peripheral joints together define an inner chamber within the bag, at least one separation joint extending from the top part of the second peripheral joint of the one side and extending towards the first peripheral joint and dividing the inner chamber into a top chamber and a bottom chamber the top defining a top opening communicating with the top chamber the area of the one side defining a side opening communicating with the bottom chamber and the separation joint establishing a restriction of communication between the top chamber and the bottom chamber for preventing the product when received within the top chamber from being transferred to the bottom chamber so as to allow the product received within the top chamber to be separated from liquid contained within the top chamber or supplied to the top chamber through the top opening and allowing the liquid to be expelled from the top chamber into the bottom chamber through the restriction of communication between the top chamber and the bottom chamber and further allowing the liquid to be expelled from the bottom chamber through the side opening.

According to the teachings of the present invention, the separation between the top chamber and the bottom chamber which top chamber constitutes an inner chamber for receiving the product such as a food product and which bottom chamber constitutes a receptor chamber for receiving the liquid separated from the product is established by means of the separation joint which extends from the top part of the second peripheral joint of the one side. The separation joint is positioned in a sloping orientation extending from the top part of the second peripheral joint of the one side towards the first peripheral joint thereby providing the transition between the bottom chamber and at the same time delimiting the upper boundary of the bottom chamber for guiding the liquid or water to be expelled from the bottom chamber to the side opening.

Although the bag is described and defined comprising two foil layers, the bag may on the one hand comprise additional outer or inner layers constituting separation or closing layers or outer protective or closing off layers and on the other hand be produced from a single foil layer which has been folded for establishing two oppositely positioned foil layers constituting the at least two foil sheet-shaped foil layers of the bag according to the present invention.

As stated above, the multipurpose bag according to the present invention may be used for at least three purposes, namely storing, rinsing and/or preparing the product contained within the bag and in the below description, the utilisation of the bag for the purpose of storing and rinsing the product has been described and discussed in greater details still the ability of the bag allowing the liquid being in most instances rinsing water which is drained from the product and poured from the bag through the at least one side opening may also constitute a liquid which has been produced within the bag through the preparation of the product contained within the bag, e.g. a liquid such as a fetty substance or water drained from the product through the operation of preparing the product, e.g. in a microoven boiling or cooking operation or in a frying or cooking operation within a conventional oven. In the below description, the liquid to be separated from the product contained within the water is unless otherwise described referred to as rinsing water exclusively.

The position of the side opening further allows the rinsing operation to be carried out as a continuous operation having the water expelled or poured onto the product received within the top chamber of the bag as the water simply flows through the top chamber causing the rinsing of the product received therein to the bottom chamber through the restriction and raises to a level corresponding to the height of the side opening above the bottom and is expelled through the side opening. Consequently, a continuous rinsing operation may be carried out and at the same time due to the elimination of the separate tubular channel at the side of the bag as disclosed in the above published international patent application, the foil material is more efficiently utilised as the expelling opening constituted by the side opening is positioned in the bottom chamber rather than at the end of a separate tubular channel.

The bag according to the present invention may be implemented in numerous different configurations including asymmetrical and symmetrical configurations. According to the presently preferred embodiment of the present invention, the bag is preferably of a substantially symmetrical configuration having two separation joints extending from the second peripheral joints and converging towards one another for providing at least one opening between the two separation joints constituting the restriction of communication between the top and the bottom chamber. Further, according to the present preferred, symmetrical configuration of the bag, the bag preferably has two side openings at respective sides of the bag allowing the bag to be operated as a symmetrical element which as will be described below will be used in an operation of tilting to the one side or to the other side for expelling water during the rinsing and the draining operation.

Although the bag according to the present invention may per se be implemented in any geometrical configuration and from any foil configuration, the two foils are preferably for obtaining a rational production and providing an easily handable product made from two rectangular foils or from a single rectangular foil which is folded along a transversal fold for establishing the two sheet-shaped foil layers as the transversal foil defines or constitutes the first peripheral joint. The materials to be used for the bag have to be biological acceptable and are preferably constituted by plastics materials which further advantageously are of a type allowed to be contacted with foodstuffs, e.g. polymer materials such as PP or PE, e.g. LDPE, MDPE or HDPE.

The bag according to the present invention should be configurated in a size allowing the bag to be on the one hand manipulated by the user and on the other hand for receiving the product and allowing the product to be properly cleaned or rinsed. According to the presently preferred embodiment according to the present invention, the bag preferably has a maximum length between the top and bottom of the order of 20–100 cm, such as 30–70 cm, e.g. 40–60 cm, preferably approximately 50 cm, and a maximum width of the order of 10–60 cm, preferably of the order of 20–40 cm, such as approximately 30 cm.

The side opening characteristic of the present invention may as will be understood be located in any position along the one side of the bag. Preferably the side opening is located at a position between approximately 0 and 70%, such as between 20 and 60%, approximately between 10 and 50% above the bottom and the side opening defining a width along the side of the order of 1–25%, e.g. 2–10%, preferably approximately 5% or approximately 10% of the length of the side.

The side opening may according to alternative embodiments be constituted or established by an unjoined area of the two foils as the top part and the bottom part of the second peripheral joint of the one side of the bag is simply not linked to one another defining or establishing the unjoined area or alternatively be established by a cut through one of the foils or alternatively and preferably both foils such as a linear cut or a similar circular cut providing a highly advantageous technique of producing the bag.

The bag may according to alternative techniques be implemented by welding or gluing/adhesion techniques as the first and second peripheral joints and the separation joint or separation joints may be constituted by weld seams or alternatively be constituted by glued/adhered joints or further alternatively be constituted by combined welded and glued/adheres joints.

The weld seams which are preferably used for the establishment of the first and second peripheral joints and the separation joint or separation joints may be constituted by solid line weld seams such as rectilinear or curved weld seams or combined rectilinear and curved weld seams or by weld seam sets including individual rectilinear or otherwise configurated parallel weld seam segments or parallel rows of dot, circular, elliptical, quadratic or any otherwise configurated individual weld seams.

According to a further advantageous embodiment of the bag according to the present invention, the bag may be converted from the two-chamber structure into a sieve or strainer structure as the bag may include indications or generator such as cut or weakening lines for the separation of a bottom part of the bag from the remaining part of the bag for allowing the bottom part to be cut off or torn off the remaining part of the bag.

The above further advantageous embodiment of the bag according to the present invention the bag being a multipurpose bag including indications or generators for the separation of the bottom part of the bag from the remaining part may apart from allowing the bag to be used as a sieve or strainer structure also advantageously be used in an operation involving blanching or cooking a product such as a vegetable product as will be described in greater details below with reference to the drawings within a pot as the bag may be hung in an upright position within the pot during the blanching or cooking operation and after the finalising of the blanching or cooking operation, the bag is simply raised from the pot allowing the water to be separated from the vegetable products or any other food products contained within the bag whereupon the product is simply expelled from the top opening of the bag into a dish or container to be used for serving, eating or storing the product.

In the use of the bag as a storage bag, the bag is preferably implemented in accordance with an embodiment in which at least one of the two foil layers comprises an extension at the top thereof for providing a turned-over flap allowing the top opening of the bag to be closed by means of the turned-over flap and subsequently re-opened.

In accordance with a particular embodiment of the bag according to the present invention, a further joint is provided in the bottom chamber of the bag constituting a guide for the guiding of water from the restriction or communication towards the side opening for preventing the water flushing through the bag from tearing the bag apart at the separation joint or at the first peripheral joint due to excessive exposure to water pressure.

According to a particular feature of the bag according to the present invention, the separation joint defines a multiplicity of individual water transmission restrictions preventing the transmission of water from the top chamber to the bottom chamber unless the water contained within the top chamber be exposed to a force exceeding the gravitational force thereby providing a bag which prevents any spilling of water through transmission of water from the top chamber to the bottom chamber until the water is pressed through the transmission restrictions which is easily accomplished by swinging the bag around generating a large centrifugal force.

The foils from which the bag according to the present invention is made may be constituted by continuous or perforated foils or alternatively or additionally transparent or non-transparent foils. According to a particular advantageous feature of an advantageous embodiment of the bag according to the present invention, one or both of the two sheet-shaped foil layers may be provided with microperforations. In this context, the expression microperforations means perforations of a size allowing steam to evaporate through the perforations and preferably preventing water from permeating through the perforations or at least restricting the permeation of water through the perforations. The microperforations may have any configuration such as circular or linear segment configuration, e.g. having an opening corresponding to a circular perforation having a diameter of less than 1 mm such as 0.1–2 mm, e.g. 0.5–1 mm, preferably approximately 1 mm. The number of microprefrorations may vary still preferably provide the access of air to the product contained within the bag and allow for the evaporation of steam and moisture from the product contained within the bag thereby increasing the time of storage during which the product may be contained within the bag without being deteriorated through excessive exposure to water. It has turned out that an advantageous number of microperforations is established provided the number being of the above size is present in an amount varying between 2 and 2,000 microperforations/$cm^2$ such as 5–1,000 microperforations/$cm^2$, preferably approximately 5–50 microperforations/$cm^2$. The microperforations may be provided having identical or different dimensions and shape and may be located or positioned in any part of the bag preferably in the top part of the bag, e.g. in a pattern covering the major top part of the bag or simply within the top chamber of the bag.

The ability of venting the product contained within the bag during storing the product within the bag, e.g. in a refrigerator and allowing air to be vented to and from the product may alternatively be established by means of one or more holes in one or both foils of the bag. The hole or holes may be established preferably at the top half of the bag for establishing communication between the top chamber of the bag and the environments which hole or holes may further serve as gripping or hanging hole or holes for manipulating the bag and the product contained therein or alternatively for hanging the bag in the above described upright position in a pot while the product is blanched or cooked as described above. The hole or holes may have any configuration such as a circular configuration, a rectangular or square configuration, an elliptical configuration or a polygonal configuration or any combination of the above or any other geometric shape or configuration. The hole or holes may have a size corresponding to the size of a circle having a diameter of e.g. 10 mm such as a diameter between 2 and 50 mm, e.g. 5 and 25 mm. Provided more than a single hole be provided, the holes may be arranged in a single row or alternatively in two or three rows preferably at the top of the bag juxtaposed the top opening.

Although the entire bag may according to the above advantageous embodiment including microperforations be implemented from a foil including microperforations, it is, however, preferred that the microperforations be located above the at least one separation joint exclusively.

The present invention further relates to the use of the bag according to the invention for for rinsing a product contained within the bag, and/or for storing said product within the bag, and/or for preparing by blanching, boiling, cooking, frying etc. the product contained within said bag.

BRIEF DESCRIPTION OF THE DRAWINGS

The present invention is now to be further described with reference to the drawings in which

FIG. 11*b* is a side view of the eleventh embodiment;

DETAILED DESCRIPTION OF THE INVENTION

Figures 1A, 1B:
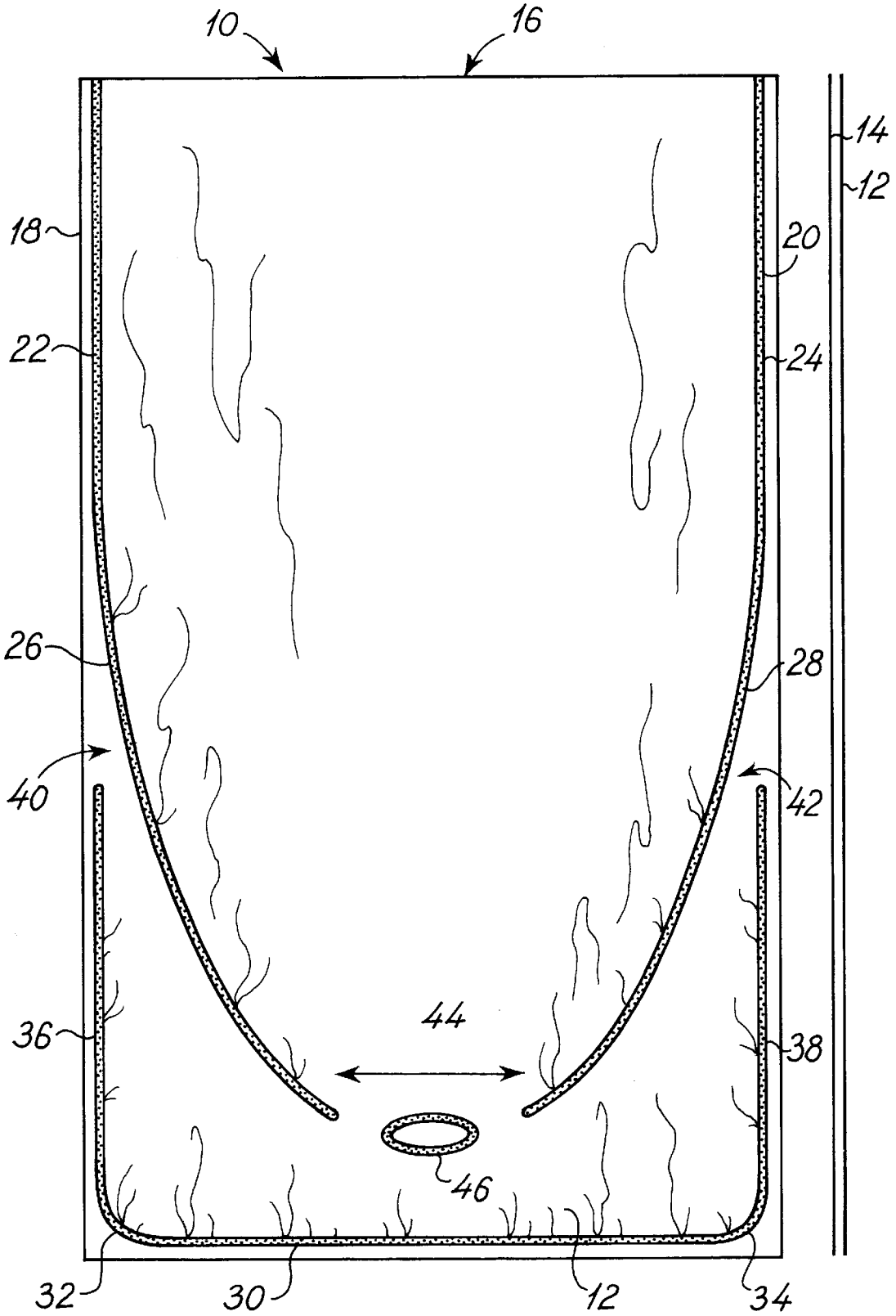
FIG. 1*a* is a plan, schematic view of a first embodiment of a multipurpose bag according to the present invention.
FIG. 1*b* is a side view of the first embodiment.

FIGS. 1*a* and 1*b*, a first embodiment of a multipurpose bag for storing, rinsing and optionally preparing a product such as a food product, e.g. vegetables, fish or meat products, in particular salad or similar vegetables is shown. The bag is intended to be used for storing the food product in question within an inner chamber defined within the bag and further intended to be used for rinsing the food product in question as will be described in greater details below and optionally, additionally or alternatively intended to be used for preparing the food product in question as will also be described in greater details below.

The multipurpose bag illustrated in FIGS. 1*a* and 1*b* is in its entirety designated the reference numeral 10 and is illustrated in a front and side view which front view illustrates the bag which is composed as illustrated in the side view of two plastic foils such as plastic foils made from LD or HDPE, PP or any other plastics material which is allowed to be brought into contact with food products such as vegetables, meat or fish products. The two foils constitute a front foil and a rear foil and are designated the reference numerals 12 and 14, respectively. The two foils 12 and 14 are coextensive and of identical dimensions and therefore in the plan view of FIG. 1, only the front foil 12 is seen as the rear foil 14 is hidden behind the front foil 12. The two foils 12 and 14 may be made from transparent or intransparent plastics materials. The foils may according to further alternative or additional features be constituted by continuous or alternatively perforated, preferably microperforated foils, as will be described in greater details below. Also according to a particular feature of the present invention, the foils or one of the foils from which the bag is produced may be provided with printings established in a heat printing process for presenting information to the use such as instructions for intentional use of the bag or alternatively the name of the product or the name of the supplier or manufacturer.

The front and rear foils 12 and 14 are joined together by means of joints which in the below description are referred to as welds or weld seams, however in alternative embodiments the joints may be established through alternative techniques such as gluing or otherwise adhering the foils together or in a combined gluing and melting/welding technique.

The front and rear foils 12 and 14, respectively, are joined together along the bottom and sides of the two foils leaving the top of the bag open. In this context it is to be understood that terms such as up and down refer to the intentional orientation of the bag to be further discussed below in which orientation the bag is held in a substantially vertical or upright position defining a top and bottom. In FIGS. 1*a* and 1*b*, the bag is orientated in relation to the drawing sheet in the intentional upright position having the open ended top of the bag positioned at the top of the drawing sheet. The open ended top or opening of the bag 10 is designated the reference numeral 16.

The front and rear foils 12 and 14 are joined together along the opposite side edges 18 and 20 of the foil by two rectilinear weld seams 22 and 24, respectively, extending from the upper end of the bag 10 to a position approximately 40% down along the extension of the bag. From the 40% position, the two rectilinear weld seams 22 and 24 shift into curved weld seams 26 and 28, respectively, extending from the lower ends of the rectilinear weld seams 22 and 24 and extend inwardly converging towards the bottom of the bag. The front and rear foils 12 and 14 are further joined together along the bottom of the bag by a rectilinear weld seam 30 which continues at opposite ends at the lower corners of the bag into circular weld sections 32 and 34 constituting a quarter of a circular weld seam, each, and from thereon continues into two vertical weld seams 36 and 38, respectively, extending to a position approximately 40% of the length of the bag above the bottom of the bag. Consequently, as will be understood, two openings extending along approximately 20% of the side of the bag and positioned approximately at the centre of the bag are provided above the two rectilinear weld seams 36 and 38 which openings are designated the reference numerals 40 and 42, respectively.

Between the lower ends of the weld seams 26 and 38, an opening is defined constituting approximately 25% of the total width of the bag. Within the opening, an elliptical weld seam 46 is provided for establishing a narrowing of the opening between the lower ends of the inwardly converging, curved weld seams 26 and 28, which ends are designated the reference numerals 48 and 50, respectively.

The bag 10 illustrated in FIGS. 1*a* and 1*b* is used in the following manner. A product such as a foodstuff e.g. some salad leaves are put into the interior of the bag through the opening 16. The product such as the salad leaves may be kept within the inner space defined between the weld seams 22, 24 and 26, 28 and kept e.g. in a refrigerator or similar storage device. As the food product is to be rinsed, the bag is raised into its upright position as the bag is kept in the orientation illustrated in FIGS. 1*a* and 1*b* whereupon the opening 10 of the bag is used for pouring water onto the product kept within the bag. As the water is pouring onto the product, the product is rinsed and at the same time, the product may be manipulated by shifting the product around within the rinsing water. The water flows down through the openings defined between the weld seam ends 48 and 50 and the elliptical weld seams 46 and raises within the bag in a collector chamber defined below the weld seams 26, 28 and 46 until the water level reaches the level corresponding to the upper edges of the vertical weld seams 36 and 38 at the openings 40 and 42 at which point the water flows out from the bag into e.g. a sink or similar drain.

After the rinsing has been completed, the water supply is turned off and the water is now standing stationary at the bottom of the back up to the level determined by the upper edges of the vertical weld seams 36 and 38. As the bag is now tilted to one of the two sides, the water is allowed to be drained from the collector chamber through one of the openings 40 and 42 which draining operation may advantageously be accomplished by shifting the bag from left to right and vice versa. After the draining of the clear water kept within the bag is completed, any access water from the rinsing operation may easily be separated from the food product such as the salad leaves by swinging the bag around exposing the water drops and the salad leaves to a centrifugal force causing the smaller constituent such as the water drops to be forces through the openings defined between the weld seams 48 and 50 of the inwardly converging, curved weld seams 26 and 28, respectively, and the elliptical weld seams 46. By the separation of the water such as the water drops from the salad leaves, the water is collected in the collector chamber below the elliptical weld seams 46 and also the inwardly converging, curved weld seams 26 and 28, whereupon the excess water may be drained from the collector chamber through one of the openings 40 and 42 by simply tilting the bag to the left or alternatively to the right. Finally, the rinsed food product is removed from the bag through the opening 16.

After the rinsing of the product contained within the multipurpose bag, the product may be stored within the bag e.g. in a refrigerator or alternatively or later on be prepared while contained within the bag e.g. in a blanching or cooking operation as will be further described in greater details below.

In the below FIGS. 2*a* through 17, alternative embodiments are illustrated which embodiments differ from the above described first embodiment in certain geometrical aspects, still all embodiments include two foils constituting a front and rear foil and also numerous other elements already described above which elements are therefore designated the same reference numerals as discussed above or alternatively provided the embodiment includes a component or an element differing from a component or element described above still fulfilling the same purpose. The component or element in question is designated the same integer yet added a mark identifying the difference in geometry or configuration.

Figures 2A, 2B:
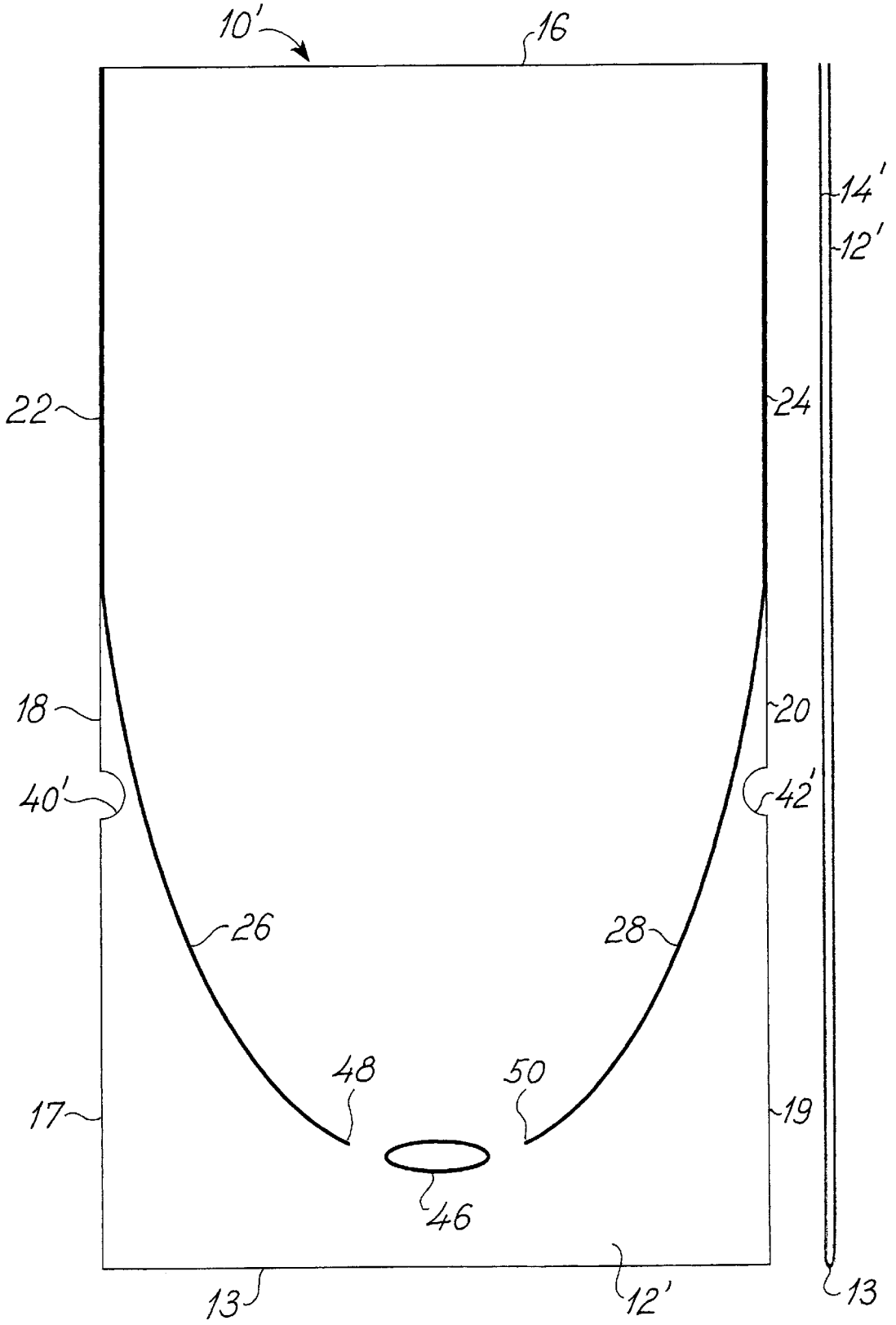
FIG. 2*a* is a view similar to the view of FIG. 1*a* of a second embodiment of the multipurpose bag according to the present invention.
FIG. 2*b* is a side view of the second embodiment.

In FIGS. 2*a* and 2*b*, a second embodiment is illustrated designated the reference numeral 10'. The second embodiment illustrated in FIGS. 2*a* and 2*b* basically differs from the above described first embodiment illustrated in FIGS. 1*a* and 1*b* in that the front and rear foils 12 and 14 are joined together at the bottom through a foil part 13 and consequently constitute a continuous foil which is further joined together along the side edges of the bag as the two foils 12' and 14' are joined by side joints 17 and 19. Still, the vertical rectilinear weld seams 22 and 24 are included in the second embodiment 10' illustrated in FIGS. 2*a* and 2*b* along with the inwardly converging, curved weld seams 26 and 28 and further the elliptical weld seam 46. As the edges 18 and 20 of the bag are unitary joined together along the side joints 17 and 19, side openings of the bag are established through punched holes 40' and 42' serving the same purpose as the unwelded open areas described above and designated the reference numerals 40 and 42 in FIGS. 1*a* and 1*b*.

Figures 3A, 3B:
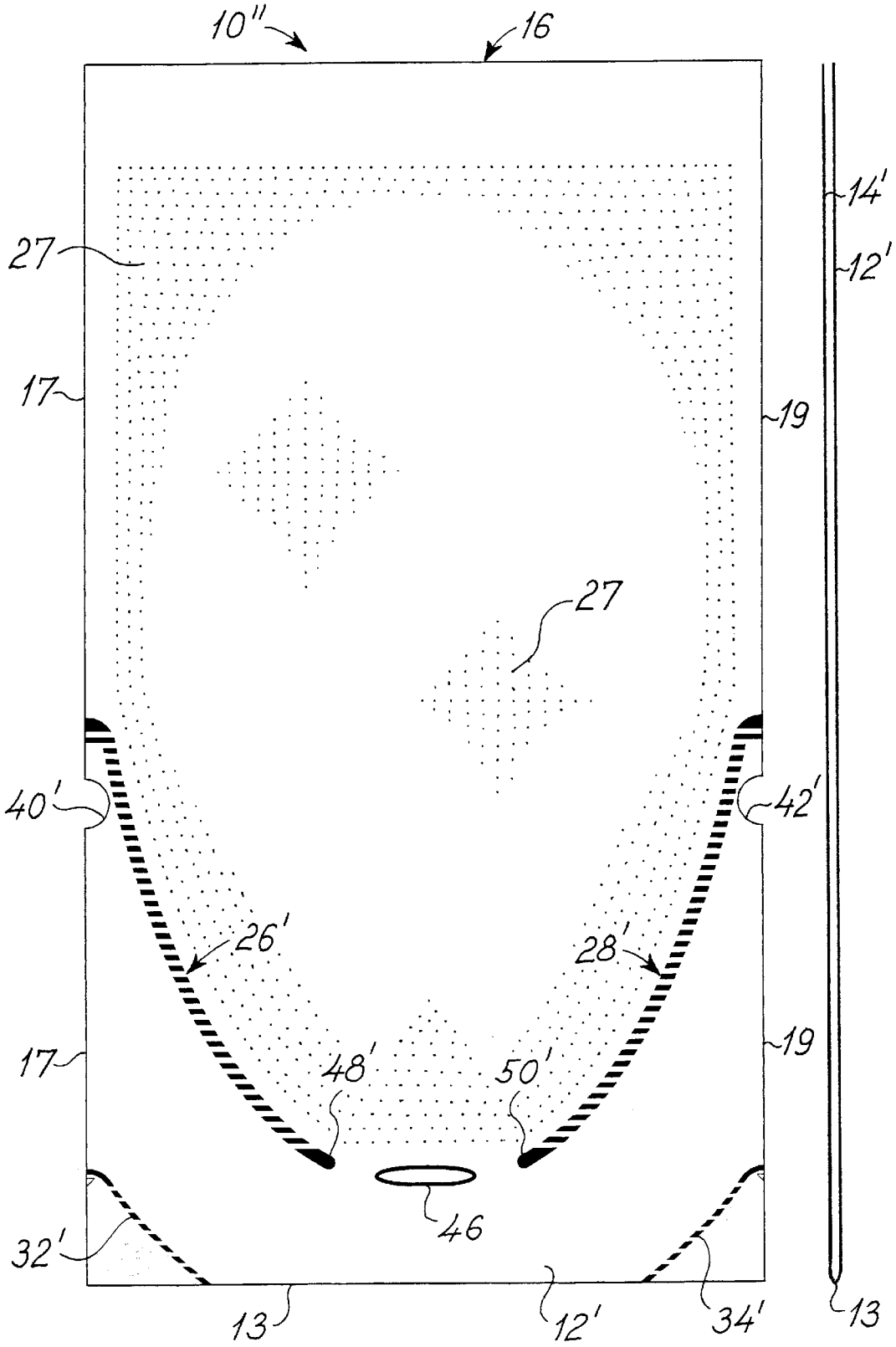
FIG. 3*a* is a view similar to the views of FIGS. 1*a* and 2*a* a third embodiment of the multipurpose bag according to the present invention.
FIG. 3*b* is a side view of the third embodiment.

In FIGS. 3*a* and 3*b*, a third embodiment 10" of the bag according to the present invention is shown which bag differs from the above described second embodiment 10' illustrated in FIGS. 2*a* and 2*b* in that the vertical weld seams 22 and 24 are omitted as the two foils 12' and 14' are integrally joined through the side joints 17 and 19 as described above and further in that the inwardly converging, curved weld seam 26 and 28 are substituted by sets of individual, parallel, linear weld seams together constituting the inwardly converging welds 26' and 28', respectively, defining the inner chamber of the bag and the collector chamber. For reinforcing the corners of the bag 10" illustrated in FIGS. 3*a* and 3*b*, two additional sets of linear weld seams are provided at the lower corners of the bag which weld seams are designated the reference numerals 32' and 34'.

The third embodiment 10" of the bag according to the present invention is further as is evident from FIGS. 3*a* and 3*b* provided with perforations, preferably microperforations, which are established covering a substantial area of the bag located above the sets of individual, parallel, linear weld seams together constituting the inwardly converging welds 26' and 28'. The micoperforations are designated the reference numeral 27 and may be provided in a number of the order of approximately 850 microperforations/$cm^2$ and may advantageously have a size corresponding to the area of a circle having a diameter of less than 1 mm, such as 0.5 mm. The microperforations may be established by perforating the above area of the bag by means of a punching tool having a number of outwardly protruding pins for producing the individual microperforations.

In FIGS. 4*a*, 4*b*, 4*c*, and 4*d*, a first and a second version of a fourth embodiment according to the present invention is shown designated the reference numerals 10'" and 10$^{iv}$, respectively. The first and second versions of the fourth embodiment of the bag according to the present invention basically differ from one another in that the second version of the fourth embodiment as compared to the first version of the fourth embodiment and also the first, second and third embodiments described above, is a convertible version allowing the bag to be converted from a bag into a strainer or sieve as will be described below.

The two versions are both of configurations basically corresponding to the above described first embodiment 10 shown in FIGS. 1*a* and 1*b*, however amended by the substitution of the linear weld seams into sets of parallel linear weld segments according to the third embodiment described above with reference to FIGS. 3*a* and 3*b*. Consequently, the outer linear weld seams 22 and 24 of the first embodiment 10 illustrated in FIGS. 1*a* and 1*b* is substituted by sets constituting linear outer weld seams of mutually parallel linear weld segments which sets are designated the reference numerals 22' and 24', respectively. Similarly, the weld seams 26 and 28 illustrated in FIGS. 1*a* and 1*b* are substituted by sets 26' and 28' of mutually parallel linear weld segments. The transition between the linear sets 22', 24' and the inwardly converging, curved sets 26', 28' are constituted by reinforced areas in which the individual linear weld segments constituting the composite weld seam sets are enlarged providing reinforced welded areas 23 and 25, respectively. The reinforcing areas 23 and 25 provide a configuration of the transition between the linear sets 22', 24' and the inwardly converging, curved sets 26', 28' establishing openings 40" and 42", respectively, of a configuration somewhat similar to the semicircular cuts 40' and 42', respectively, shown in FIGS. 2*a*, 2*b* and 3*a* and 3*b* of the second and third embodiments 10' and 10", respectively.

The vertical lower welds 36 and 38 of the first embodiment 10 illustrated in FIGS. 1*a* and 1*b* are further in the first and second version of the fourth embodiment illustrated in FIGS. 4*a*, 4*b*, 4*c*, and 4*d*, respectively, substituted by sets 36', 38', respectively, of mutually parallel linear weld segments each of a configuration identical to the configuration of the individual weld segments of the sets 22' and 24'. The bottom weld of the fourth embodiment similar to the weld 30 of the first embodiment 10 is constituted by a set 30' of mutually parallel, yet vertical weld segments of a width and length corresponding to the width and length, respectively, of the weld seam segments of the sets 22', 36', 24' and 38', yet being orientated vertically rather than horizontally as distinct from the horizontal orientation of the individual weld segments of the vertical weld seam sets 22', 24', 36' and 38'.

The welds joining the vertical weld seam sets 36', 38' and the horizontal weld seam set 30' are constituted by sets of mutually parallel, horizontal weld seam segments together constituting two sets 32" and 34" having individual weld seam segments of a varying width providing a reinforcing of the corners of the bag similar to the reinforcing of the third embodiment 10" illustrated in FIGS. 3*a* and 3*b* and further similar to the reinforcing feature of the areas 23 and 25 of the fourth embodiment described above.

The elliptical weld seam 46 of the above described first, second and third embodiments is substantially a total of five individual minor elliptical weld seams 46' providing a somewhat enlarged opening between the two end parts 48" and 50" of the weld seam set 26' and 28', respectively, as compared to the opening between the two end parts 48 and 50 of the first embodiment shown in FIGS. 1*a* and 1*b* allowing an enlarged water flow as compared to the first embodiment 10 still establishing a restriction allowing for the separation of the material of minor size as compared to the first, second and third embodiment. At the center of the bag below the central elliptical weld seam 46, a basically triangularly shaped weld seam set 47 is provided serving as a water guide for guiding the water from the openings established between the ends 46", 50" and the individual elliptical weld seams 46' and between the individual elliptical weld seams 46' towards the lower corners adjacent the reinforced weld seam sets 32", 34" and at the same time providing a restriction of the overall volume below the weld seam sets 26' and 28', i.e. the collector chamber of the sieve or strainer structure and relieving the pressure on the minor elliptical weld seams 46'.

As stated above, the difference between the first and second version 10'" and 10$^{iv}$ of the fourth embodiment of the bag according to the present invention, is the ability of the second version of being converted from a combined sieve/strainer and centrifugal separator bag into a sieve/strainer structure exclusively as the bag is provided with two cuts 60 and 62 at a position adjacent to the reinforced weld seam sets 32" and 34", respectively, and at a height above the bottom of the bag just above the triangularly shaped reinforcing weld seam set 47. Between the two cuts 60 and 62, weakening spots or areas 64 are provided in at least one of the two foils 12 and 14 and preferably in both foils for allowing the user of the bag to readily separate the bottom part of the bag along a line defined by the weakening spots or areas 64 from the remaining top part of the bag through simply tearing the bottom part off the remaining top part thereby converting the bag into a sieve/strainer structure. Alternatively, the foil material used for the bag may be a linearly extruded foil material providing an easily self-tearable foil bag.

The first and second version of the fourth embodiment of the bag according to the present invention is at its top end further provided with a turned-over flap 15 constituting an extension of the rear foil 14 which flap allows the bag to be closed. Alternatively, the bag may in the above and the below described embodiments be provided with a different or alternative kind of closure such as a zipper-closure.

Further, the fourth embodiment of the bag according to the present invention is provided with an elongated aperture 11 at the top of the bag, just below the turned-over flap 15 of the rear foil 14 which aperture serves the purpose of allowing a user to grasp the bag and use the three-ply area provided above the aperture 11 by the rear foil 14, the front foil 12 and the turned-over flap 15 as a handle in the process of separating water from the product or products contained within the bag in the centrifugal separation or alternatively simply in an operation of moving the product contained within the bag from one position to another such as to and from a sink and to and from a refrigerator or similar storage appliance.

Figures 4A, 4B:
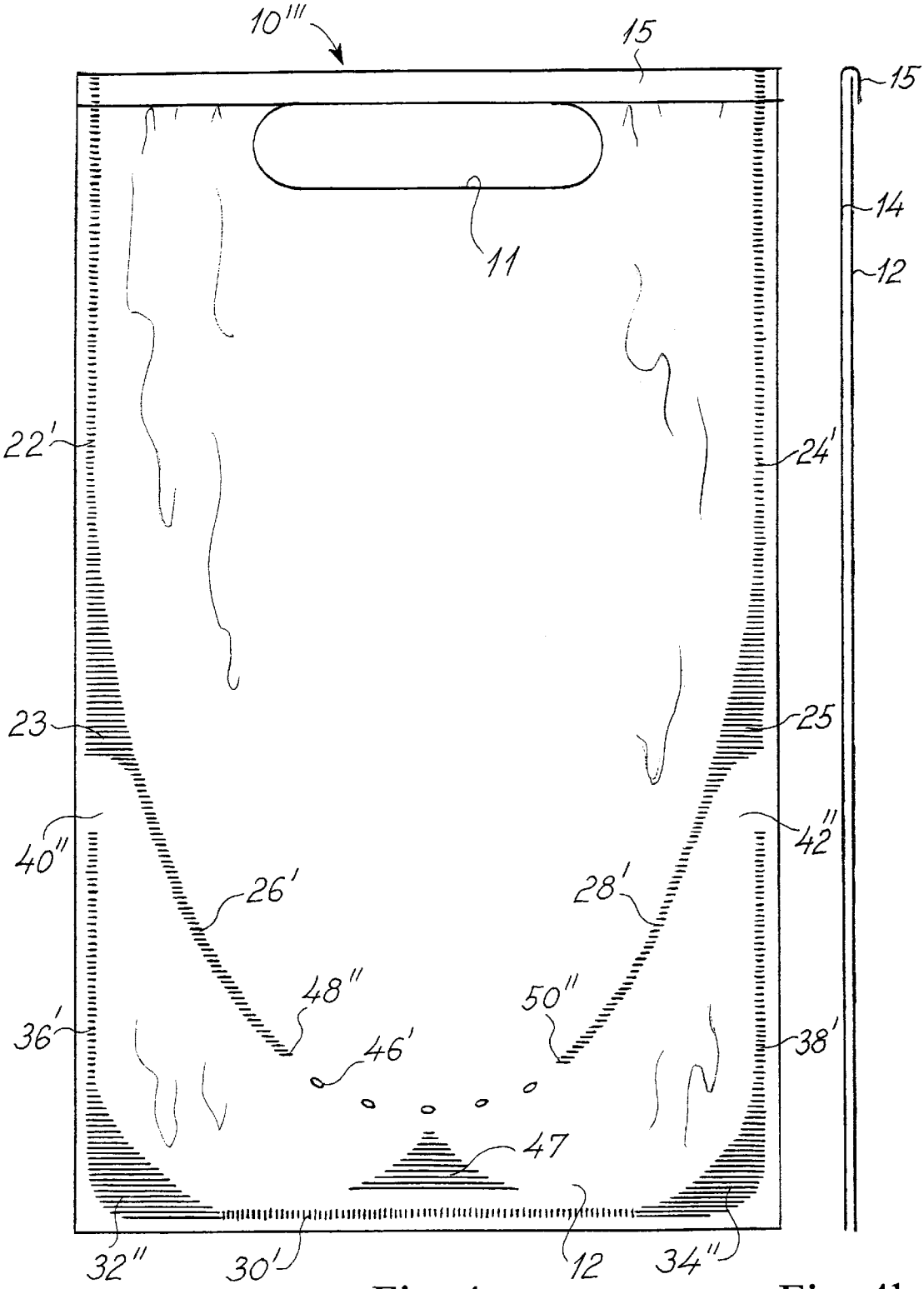
FIGS. 4*a* through 4*d* are views similar to the views of FIGS. 1*a* through 3*b* of two alternative versions of a fourth embodiment of the multipurpose bag according to the present invention.
Figures 4C, 4D:
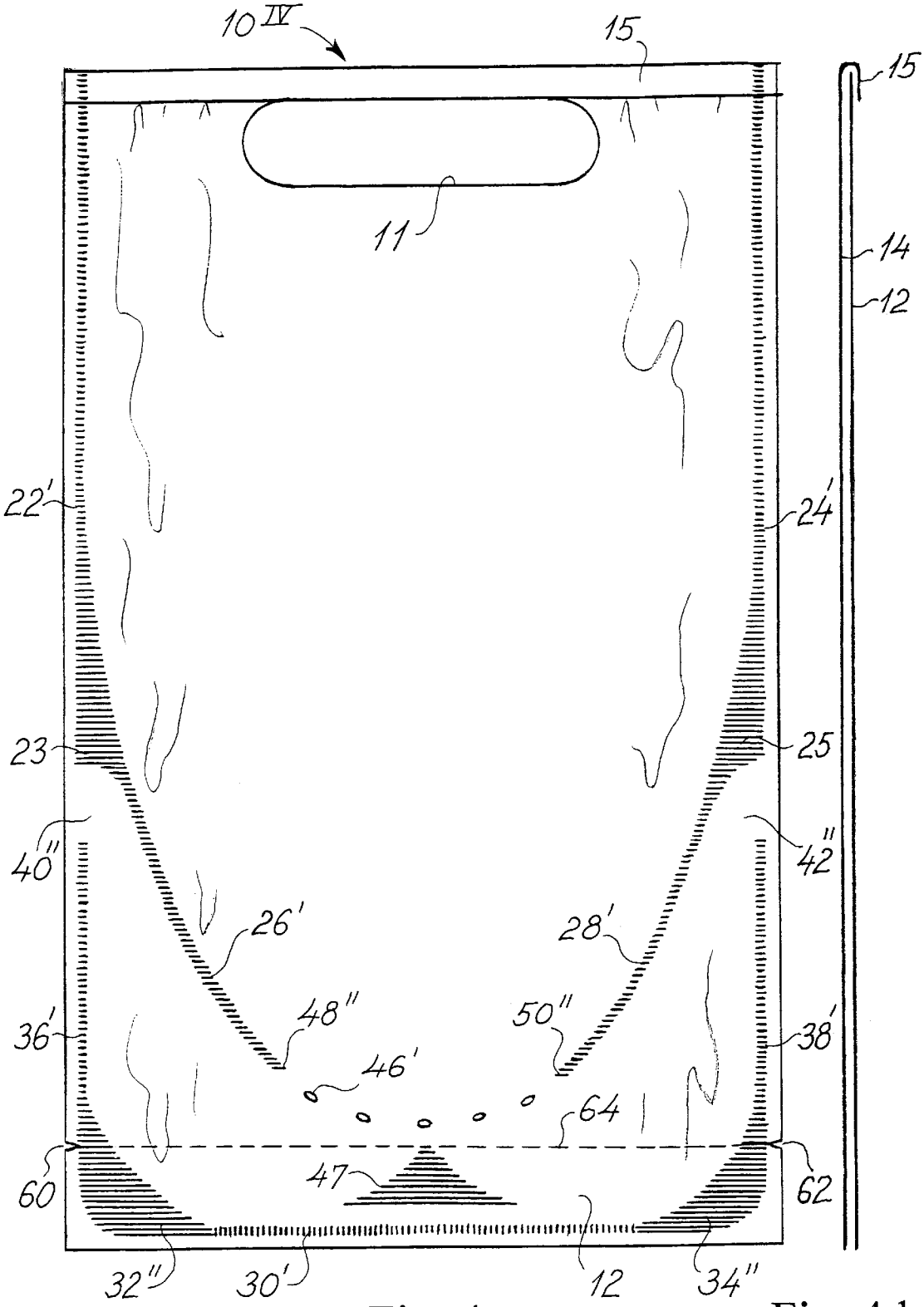
Figures 5A, 5B:
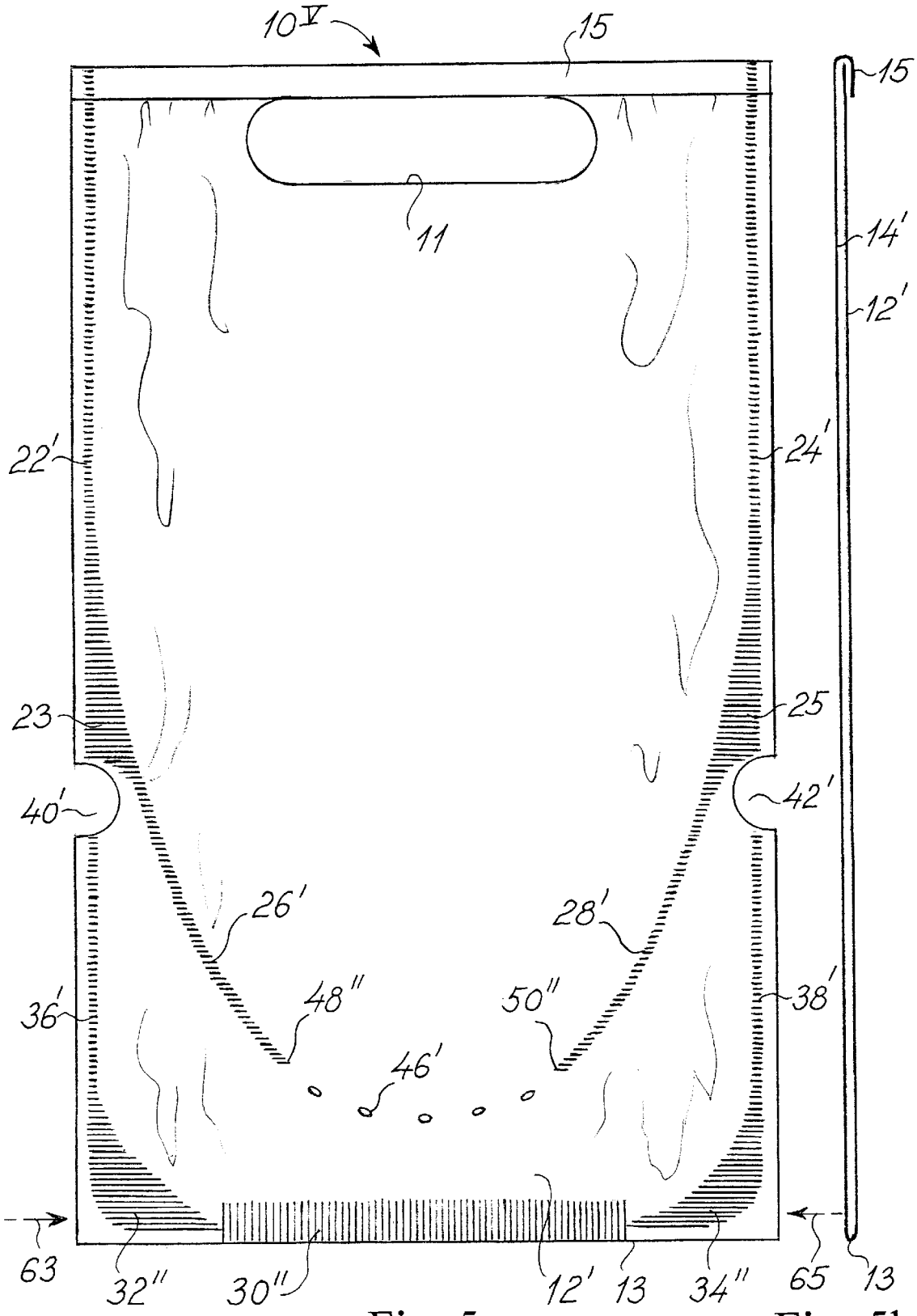
FIGS. 5*a* and 5*b* are views similar to the views of FIGS. 1*a* and 1*b* of a fifth embodiment of the multipurpose bag according to the present invention.

In FIGS. 5*a* and 5*b*, a fifth embodiment $\mathbf{10}^{v}$ by of the bag according to the present invention is shown which bag is of a structure based on the fourth embodiment of the bag illustrated in FIGS. 4*a* through 4*d*, still deviating from the fourth embodiment in three aspects. Firstly, the openings 40" and 42" of the fourth embodiment is substituted by the cut apertures 40' and 42' of the second and third embodiments 10' and 10" shown in FIGS. 2*a*, 2*b*, and 3*a*, 3*b*, respectively. Secondly, the central basically triangularly shaped reinforcing weld seam set 47 of the fourth embodiment is omitted and thirdly the bottom weld seam set 30' is substituted by a weld seam set including individual linear weld seams of a length exceeding the length of the individual linear weld seam segments of the set 30.

The fifth embodiment $\mathbf{10}^{v}$ is further due to the presence of the enlarged vertical weld seam segments of the horizontal bottom weld seam set 30" of a structure allowing the bag to be converted from the sealed centrifugal separator bag into a sieve/strainer structure exclusively like the above described second version $\mathbf{10}^{IV}$ of the fourth embodiment shown in FIGS. 4*c* and 4*d*. The conversion of the fifth embodiment $\mathbf{10}^{v}$ into a sieve/strainer structure is simply established by cutting by means of e.g. a scissors or knife the lower part of the bag off from the remaining top part of the bag e.g. along a line indicated in FIG. 5*a* by two arrows 63 and 65 at the left hand and the right hand side of the bag, respectively. By the separation of the bottom part of the bag from the remaining top part of the bag, the foil part 13 connecting the two foils 12' and 14' together is removed and the individual vertical weld segments of the weld seam sets 30" is converted into sieve elements which allow water exclusively to be drained from the bag as distinct from the elliptical weld seams 46' which due to their spacing allow fine material such as sand or dust to be rinsed from the inner chamber of the bag into the collector chamber of the bag. As will be evident, the fifth embodiment and also the above described first, second and third embodiments may be converted into a sieve/strainer structure including a single sieve/strainer element like the above described second version of the fourth embodiment $\mathbf{10}^{iv}$ shown in FIGS. 4*c* and 4*d* by simply cutting off the lower part of the bag above the bottom weld seam set 30" and similarly above the bottom seams of the above described first, second and third embodiments.

Figures 6A, 6B:
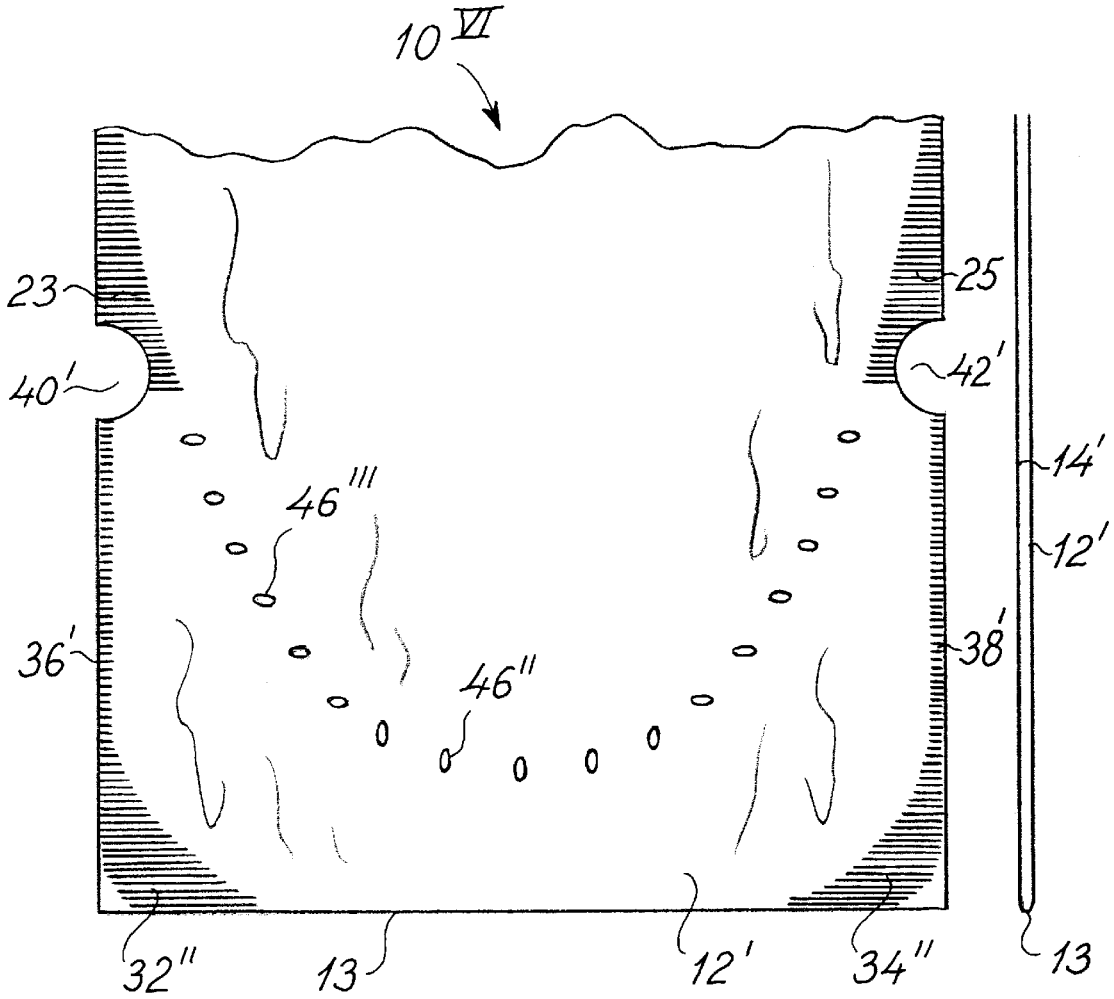
FIG. 6*a* is a plan, schematic bottom view of a sixth embodiment of the multipurpose bag according to the present invention.
FIG. 6*b* is a side view of the sixth embodiment.

In FIGS. 6*a* and 6*b*, a bottom part of a further or sixth embodiment of the bag according to the present is shown designated the reference numeral $\mathbf{10}^{vi}$ in its entirety. Basically, the sixth embodiment $\mathbf{10}^{vi}$ is of a structure originating from the above described fifth embodiment $\mathbf{10}^{v}$ shown in FIGS. 5*a* and 5*b*, however differing from the above described fifth embodiment in three aspects. Firstly, the bottom weld seam set 30" shown in FIG. 5*a* is omitted. Secondly, the elliptical weld seams 46" shown in FIG. 5*a* which weld seams are arranged along the curve represented by the weld seam sets 26', 28' and the individual weld seam 46' are substituted by a total of five individual elliptical weld seams 46" which are orientated vertically. Thirdly, the weld seam set 26' and 28' are substituted by six individual elliptical weld seams 46'" each which individual elliptical weld seams 46'" are orientated transversely or horizontally as distinct from the vertically orientated weld seams 46".

As will be readily understood, the elliptical configuration of the weld seam 46', 46" and 46'" may be amended into any appropriate alternative configuration such as a circular, a triangular, a square or quadratic configuration or any other configuration of geometrical shape or any combination of such geometrical configurations. Also as far as the orientation of the individual weld seams such as the elliptical weld seams 46', 46" and 46'" are concerned, the weld seams may be orientated taking into due consideration on the one hand the spacing between the individual weld seams defining the separation between the inner chamber and the collector chamber of the bag and influencing the sieve/strainer operation as to the ability of the sieve/strainer structure to prevent particles or material from being flushed from the inner chamber into the collector chamber and on the other hand the mechanical impact to the individual weld seams as water is pressed through the bag from the inner chamber to the collector chamber and further while manipulating the material contained within the inner chamber thereby exposing the individual weld seams separating the collector chamber from the inner chamber of the bag to fairly high mechanical stresses and forces.

Figure 7A:
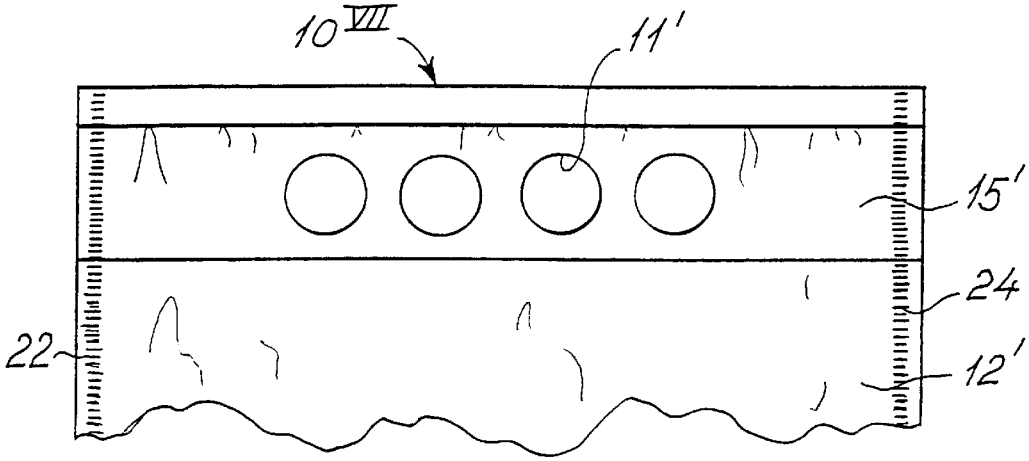
FIGS. 7*a*, 7*b* and 7*c* are details of a seventh embodiment of the multipurpose bag according to the present invention which details include modifications as compared to the embodiments illustrated in FIGS. 1*a* through 6*b*.
Figure 7B:
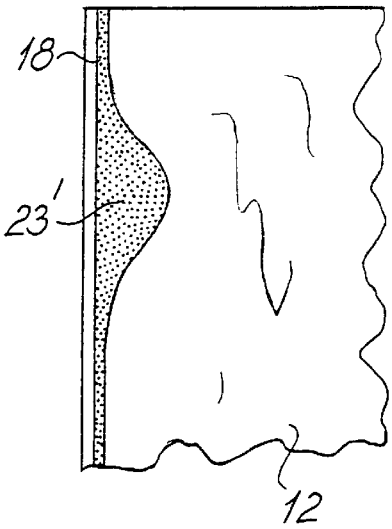
Figure 7C:
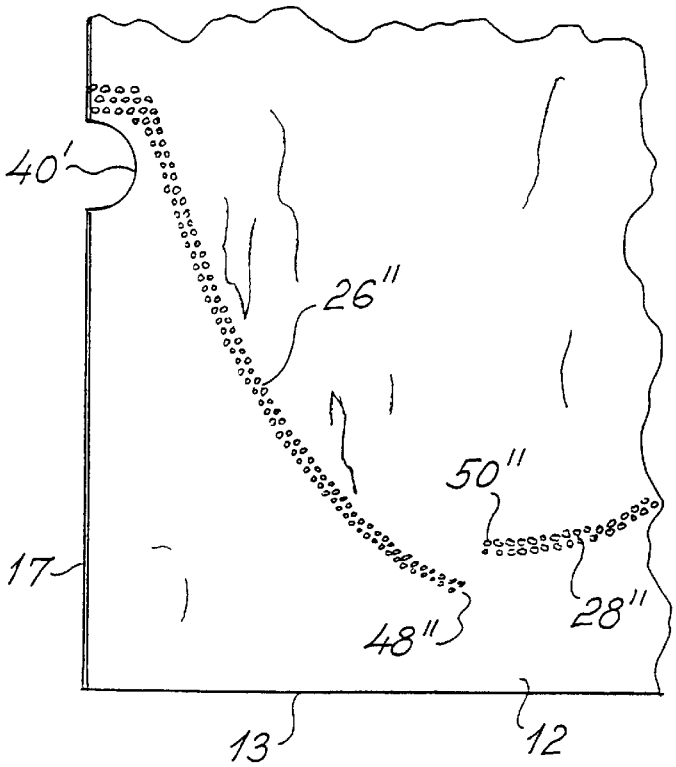

In FIGS. 7*a*, 7*b* and 7*c*, three details of a further or seventh embodiment of the bag according to the present invention is shown designated the reference numeral $\mathbf{10}^{vii}$ in its entirety. In FIG. 7*a*, the top part of the foil bag is shown in which foil bag the upper part of the above described fourth and fifth embodiments of the bag according to the present invention is modified as the turned-over flap 15 of the fourth and fifth embodiments is enlarged into a broader flap 15'. In the three-ply material including the rear foil 14', the front foil 12' and the turned-over flap 15', four finger holes 11' are punched serving basically the same purpose as the elongated hole 11 of the fourth and fifth embodiments still providing through the enlarged overlap between the turned-over flap 15' and the front foil 12' an improved sealing of the top opening of the bag. The four finger holes 11' further provide a venting of the material included in or stored in the bag and allowing the access of air to the material.

In FIG. 7*b*, a detail of the vertical, rectilinear weld seam 18 is shown in which weld seam a reinforcing protrusion 23' is established for reinforcing the material at said specific point and at the same time establish a narrowing or constriction within the bag.

In FIG. 7*c*, a further modification of the seventh embodiment illustrated in FIG. 7*a* is shown. In a detail of FIG. 7*c*, the above described third embodiment shown in FIGS. 3*a* and 3*b* has been amended by the substitution of the parallel weld seam segments constituting the weld set 26' by a plurality of circular welds arranged in two parallel rows which parallel rows together define an inwardly converging and curved weld seam set 26". The opposite weld seam set 28" is of an identical configuration, still amended by the provision of an elongation 50" which is turned upwardly relative to the corresponding end 48" of the weld seam set 26" thereby providing a vertical distance between the ends 48" and 50" of the weld seam set 26" and 28", respectively. It is to be realised that the above described embodiments are of a symmetrical configuration still according to the teachings of the detail of the seventh embodiment shown in FIG. 7*c*, the above described embodiments may readily be modified by changing the position of one of the inwardly converging and curved weld seams or weld seam sets providing a transition area or opening between the inner chamber of the bag and the collector chamber of the bag having an orientation differing from the horizontal orientation e.g. a sloping orientation as illustrated in FIG. 7*c* or alternatively a straight vertical orientation provided the two ends of the weld seams or weld seam sets such as the ends 48" and 50" are positioned above one another.

Figure 8:
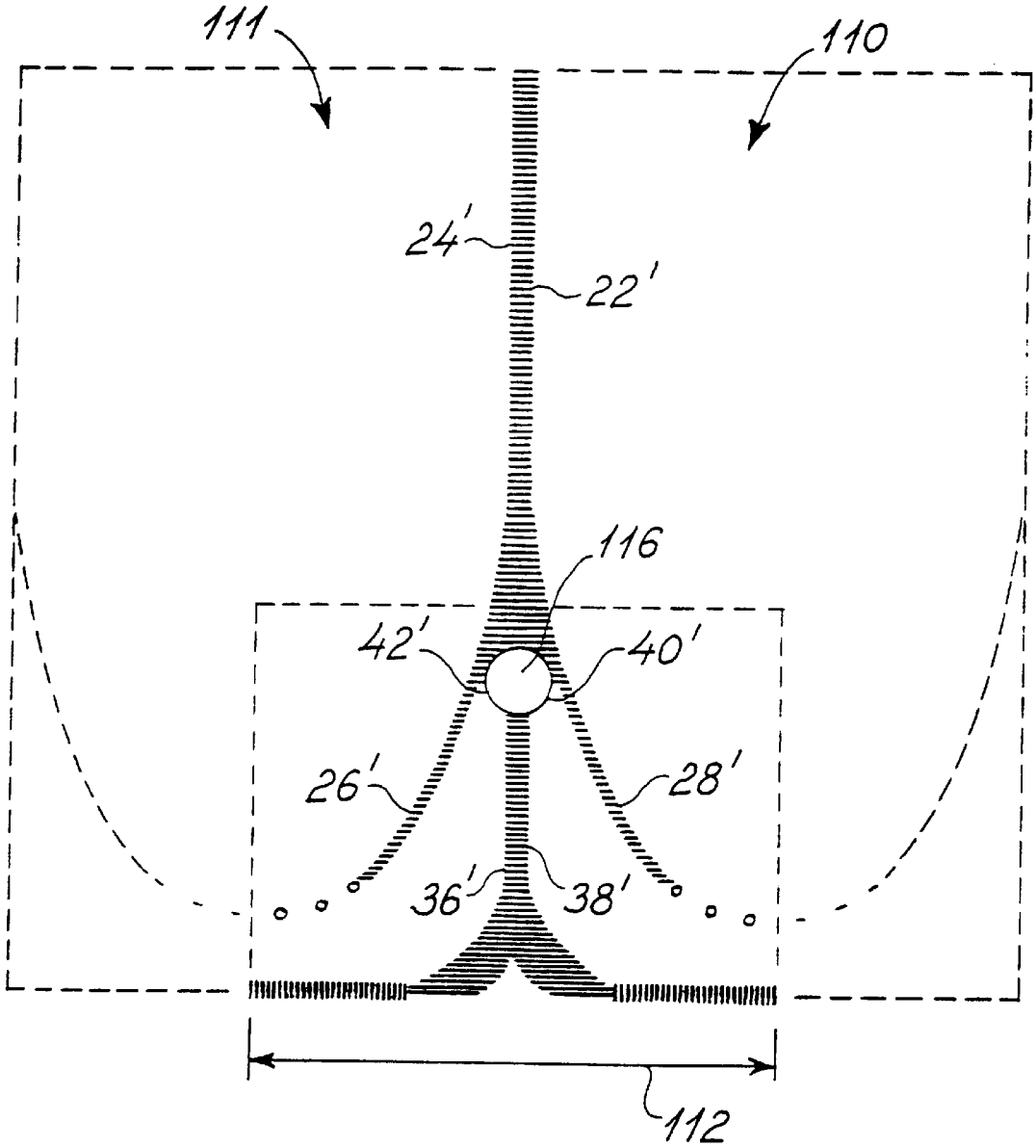
FIG. 8 is a plan, schematic view illustrating a preferred technique of producing the second, third, fifth, sixth and seventh embodiments of the multipurpose bag according to the present invention illustrated in FIGS. 2*a*, 2*b*, 3*a*, 3*b*, 5*a*, 5*b*, 6*a*, 6*b*, and 7*a*–7*c*, respectively.

In FIG. 8, an advantageous technique for the production of several of the above described embodiments is shown, a particular a technique adapted for the production of the second, third, fifth, sixth and seventh embodiments of the bag illustrated in FIGS. 2*a*, 2*b*, 3*a*, 3*b*, 5*a*, 5*b*, 6*a*, 6*b*, and 7*a*–7*c*, respectively. According to the production technique illustrated in FIG. 8, two bags designated the reference numerals 110 and 111 are produced in two steps as a heating and punching dye is used for producing in a single step the left hand part of the bag 110 and at the same time the right hand part of FIG. 111. Consequently, in a single production step, a left hand part of a first bag and a right hand bag of the second bag is produced thereby in each and every production step finalising a bag which bag in a previous step had its left hand part produced. Furthermore, provided the bags 110 and 111 are produced from a single foil, the width of the individual bag is simply established through the stroke of the tool used for producing the two parts constituting the left-hand part of the first bag and the right-hand part of the second bag.

The tool for performing the welding and cutting operation defines a width 112 corresponding to the total width of a single bag and has two half parts one of which constitutes a mirror image of the other and provides the two neighbouring halves of the two bags 110 and 111. The tool also includes a punching tool for the cutting of a hole in the welded foil materials as indicated by the reference numeral 116 which hole together constitutes the one half circular hole 40' of the bag 110 and the one half circular hole 42' of the bag 111. After the welding and punching of the two halves of the bag 110 and 111, the bag 110 is simply separated from the bag 111 by means of a knife or a heated cutter separating the two bags from one another along the centre line of the two halves and separating the weld seam set 22' of the bag 110 from the weld seam set 24' of the bag 111 and similarly separates the weld seam set 38' from the weld seam set 36' of the bag 111 and separating the hole 116 into the one-half circular hole 40' of the bag 110 and the one-half circular hole 42' of the bag 111.

Figures 9A, 9B:
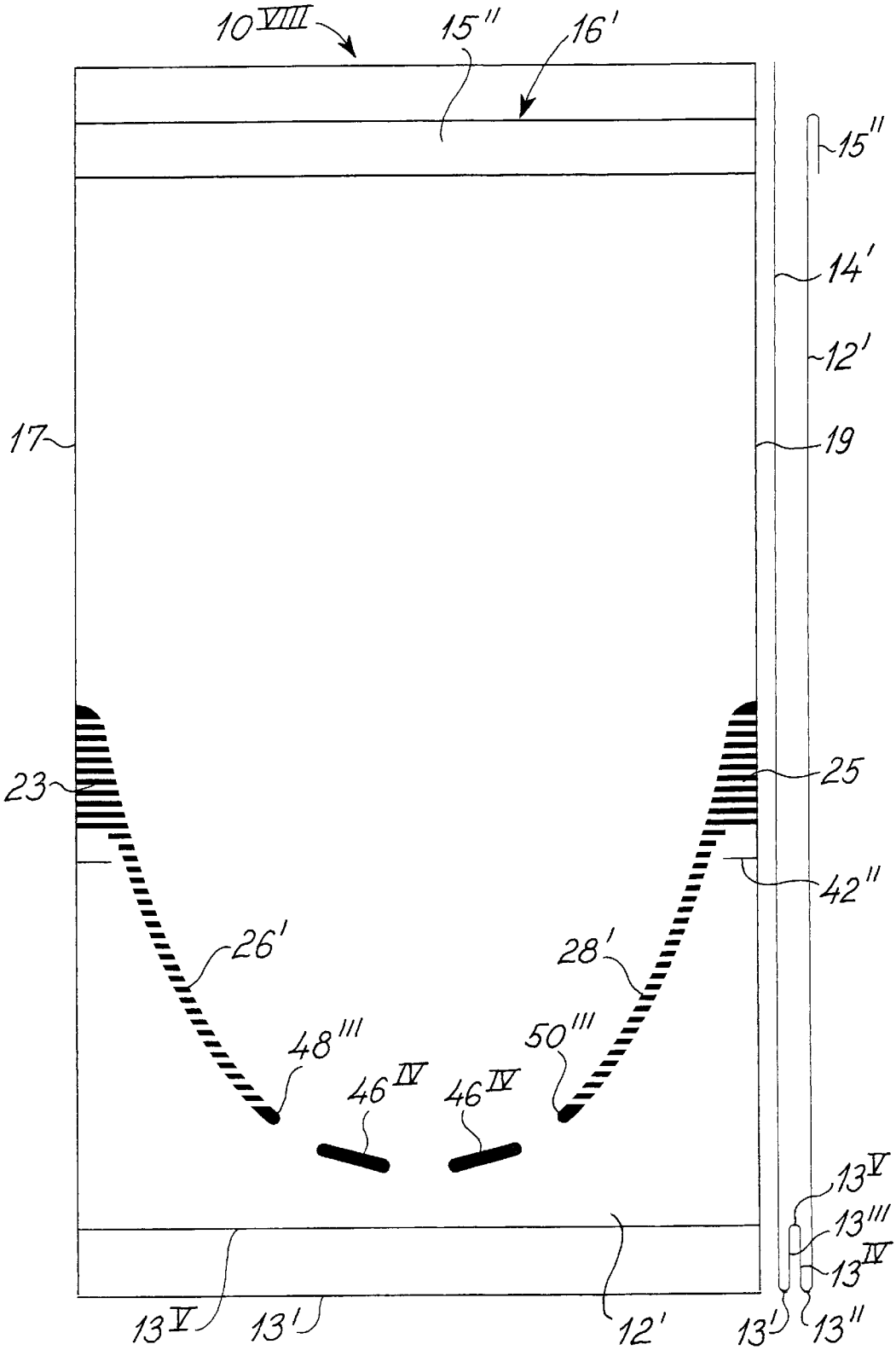
FIG. 9*a* is a plan, schematic view similar to the views of FIGS. 1*a*, 2*a*, 3*a*, 4*a*, 5*a*, and 6*a*, of an eighth embodiment of the multipurpose bag according to the present invention.
FIG. 9*b* is a side view of the eighth embodiment.

In FIGS. 9*a* and 9*b*, an eighth embodiment of the bag according to the present invention is shown designated the reference numeral $\mathbf{10}^{viii}$ in its entirety. Basically, the eighth embodiment illustrated in FIGS. 9*a* and 9*b*, constitutes a modification of the third embodiment 10" illustrated in FIGS. 3*a* and 3*b* further including specific features of the fourth embodiment illustrated in the first and second versions shown in FIGS. 4*a*, 4*b*, and 4*c*, 4*d*, respectively. The eighth embodiment is like the above described third embodiment produced from a single web defining the rear and front foils 14' and 12', respectively, and further defines a folded bottom part as the web is folded providing two inner foil parts 13''' and $\mathbf{13}^{iv}$ connected to the front and rear foils 12' and 14', respectively through foil parts 13" and 13', respectively. The inner foils 13''' and $\mathbf{13}^{iv}$ are interconnected through a further foil part $\mathbf{13}^{v}$. The folded bottom of the bag basically serves the purpose of providing a broader collector chamber below the inwardly converging, curved weld seam sets 26' and 28' which are provided with reinforced end weld seams 48''' and 50'''.

Further as is evident from FIG. 9*a*, the single elliptical weld seam 46 is substituted by two mutually spaced solid line linear weld seams $\mathbf{46}^{IV}$ which along with the reinforcing end parts 48''' and 50''' provide a total of three apertures between the inner chamber of the bag and the lower collector chamber of the bag. As is evident from FIG. 9*a*, the collector chamber communicates with the environment through a single slit 42" as distinct from the above embodiments in which two symmetrically positioned apertures or holes are provided. The provision of a single slit allows the user to close off the collector chamber by pressing the foils 14' and 12' tightly together at the slit 42" thereby allowing the bag $\mathbf{10}^{viii}$ to be used as a sealed bag in which the water may be introduced and allowed to raise to a high water level within the inner chamber of the bag in which a product such as a foodstuff product is introduced.

After the manipulating of the foodstuff product around within the water contained within the inner chamber of the bag, particles separated from the product will fall to the bottom of the collector chamber of the bag and the water may be expelled from the bag through the slit 42". Further, the provision of the slit at the one side of the bag, exclusively, allows the bag to be tilled to the left thereby positioning the slit 42" at an elevated position preventing the water from leaving the bag and thereby maintaining a high water level within the bag still by tilting the bag to the right allowing the water to be completely expelled from of the bag through the slit 42".

At the top end, the bag $\mathbf{10}^{viii}$ is provided with a turned-over flap 15" provided by the front foil 12' as distinct from the above described fourth and fifth embodiments and simply serving the purpose of providing a reinforcing web at the opening 16' of the bag.

Figures 10A, 10B:
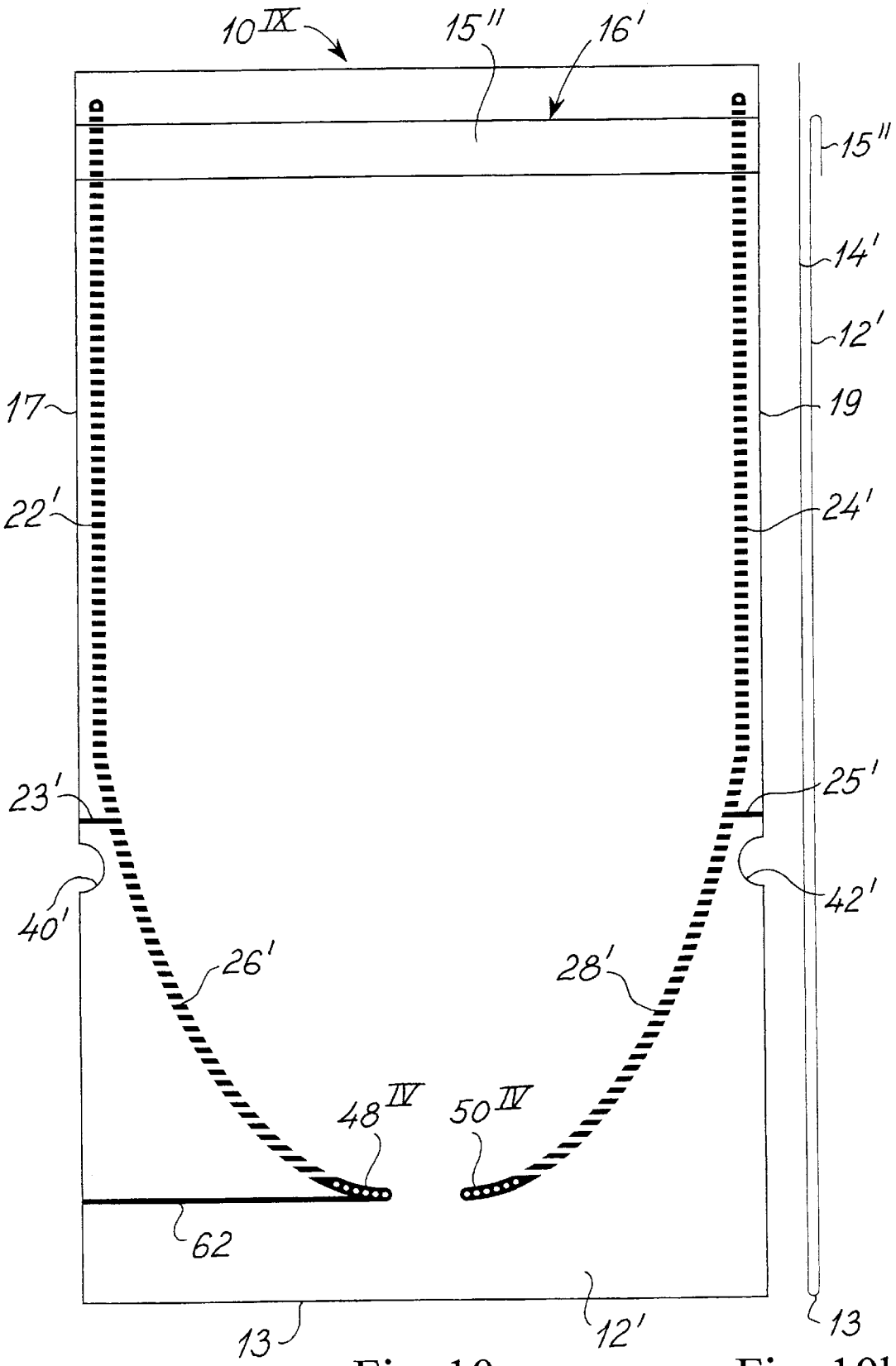
FIG. 10*a* is a view similar to the views of FIGS. 1*a*, 2*a*, 3*a*, 4, 5*a*, 6*a*, and 9*a* of a ninth embodiment of the multipurpose bag according to the present invention.
FIG. 10*b* is a side view of the ninth embodiment.

In FIGS. 10*a* and 10*b*, a ninth embodiment $\mathbf{10}^{iv}$ is shown which embodiment constitutes a combination of certain features of the above-described embodiments as the bag is produced from a single web similar to the third and fourth embodiments described above with reference to FIGS. 3*a*, 3*b*, 4*a*, 4*b*, 4*c*, and 4*d*, respectively, and defining the front and rear foils 12' and 14' joints through the foil part 13 and further having the reinforcing folded part 15" described above with reference to FIGS. 9*a* and 9*b*. The inner weld seams of the bag $\mathbf{10}^{ix}$ are basically implemented in a configuration similar to the configuration of the solid line weld seams 22, 24, 26 and 28 of the first embodiment 10 described above with reference to FIGS. 1*a* and 1*b*, yet being established by a plurality of identical and parallel solid line weld segments ending in reinforced solid weld seams $\mathbf{48}^{iv}$ and $\mathbf{50}^{iv}$ of an elongated configuration and having non-welded holes preventing the foil material of the reinforced welded end parts $\mathbf{48}^{iv}$ and $\mathbf{50}^{iv}$ from being destroyed during the welding operation through the supply of an excessive amount of heat which could cause a complete melting of the foil material.

As distinct from the above described first embodiment 10 shown in FIGS. 1*a* and 1*b* the ninth embodiment illustrated in FIGS. 10*a* and 10*b* includes no central weld seam similar to the elliptical weld seam 46 shown in FIG. 1*a*. However, for obtaining the unilateral feature described above with reference to FIGS. 9*a* and 9*b* of allowing the bag to be tilted to the one side allowing water to be expelled from the bag and preventing water from being spilled or expelled from the bag by tilting to the other side, the bag is as is evident from FIG. 10*a* provided with a bottom weld seam 62 connecting the reinforced weld seam 48$^{iv}$ with the side joint 17. For further reinforcing the bag, two additional weld seams 23' and 25' are provided which are positioned above the semi-circular apertures 40' and 42' and serving the purpose of preventing water from flowing into the spaces defined between side the joints 17, 19 and the weld seams 22' and 24', respectively.

Figures 11A, 11B:
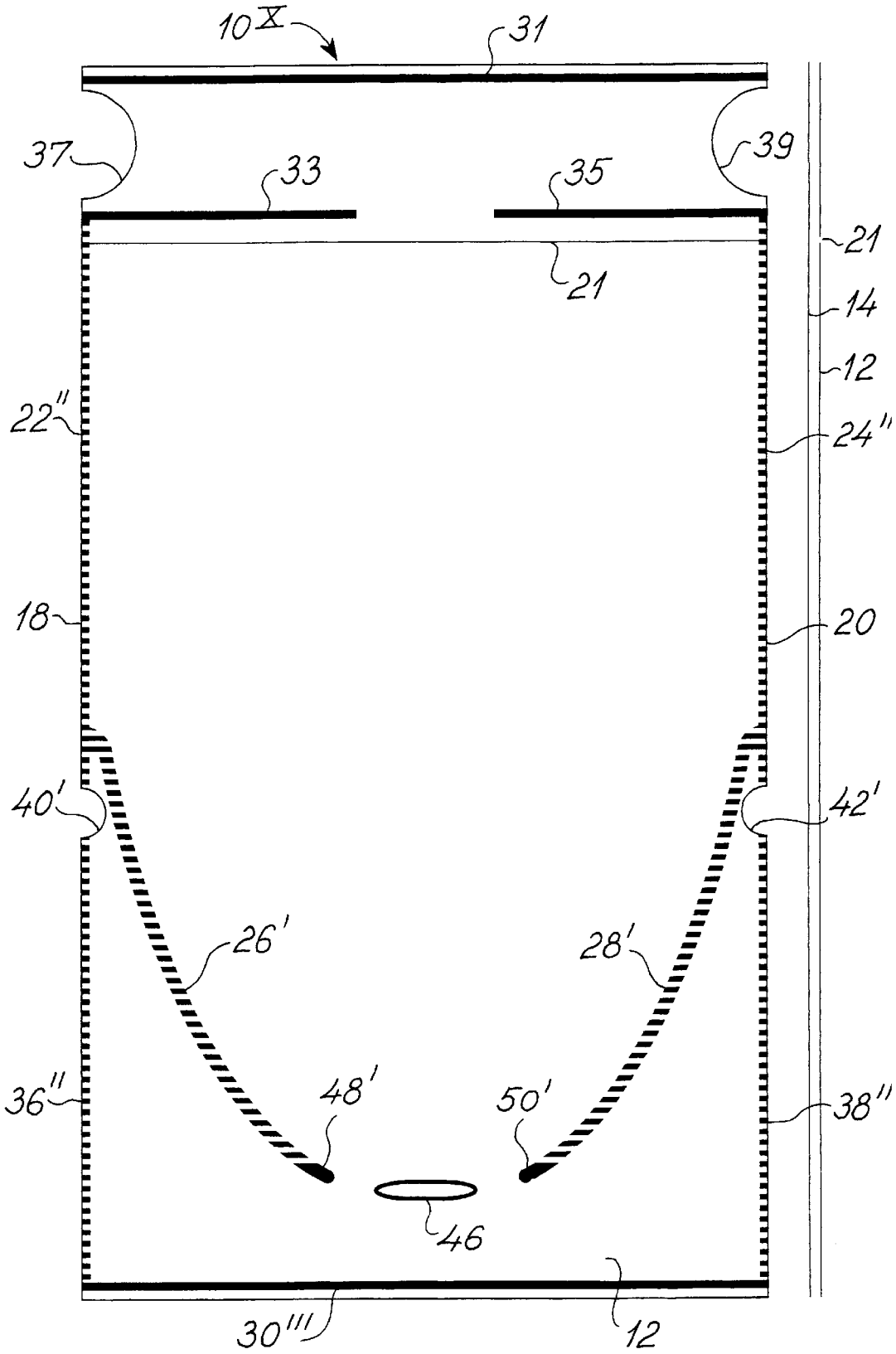
FIG. 11*a* is a view similar to the views of FIGS. 1*a*, 2*a*, 3*a*, 4*a*, 5*a*, and 6*a*, and FIGS. 9*a* and 10*a* of a tenth embodiment of the multipurpose bag according to the present invention.
FIG. 11*b* is a side view of the tenth embodiment.

In FIGS. 11*a* and 11*b*, a tenth embodiment of the bag according to the present invention is shown designated the reference numeral 10$^{x}$ in its entirety. The tenth embodiment basically constitutes a modification of the above described third embodiment illustrated in FIGS. 3*a* and 3*b* as the inner separation weld seams of the bag are established in conformity with the structure described above with reference to FIG. 3 and include 2 inwardly converging curved weld seam sets 26' and 28' each including a plurality of individual linear and parallel weld segments ending in reinforced end parts 48' and 50'. Along the outer edges 18 and 20 of the bag, the front and rear foils 12 and 14 are joined together by linear welds composed of a plurality of individual linear weld seam segments extending along the entire length or height of the bag and defining weld seams 22", 24" and 36", 38" corresponding to the above described linear welds 22, 24 and 36, 38, respectively. Along the bottom of the bag, a rectilinear solid line weld seam 30'" is provided for closing the bottom of the bag.

At the top, the bag 10$^{x}$ is provided with a rectilinear solid line weld seam 31 and two additional weld seams 33 and 35 positioned a short distance below the weld seam 31 and defining a central passage between the inner ends of the two weld seams 33 and 35. At the edges of the bag between the weld seam 31 and the two weld seams 33 and 35, semi-circular cuts 37 and 39, respectively, are provided for allowing the bag to be positioned on a tube or water tap as will be described in greater details with reference to FIG. 13. For allowing a product such as a foodstuff product to be introduced into the inner chamber of the bag, the front foil 12 is cut from the one edge 18 to the opposite edge 20 as indicated in the right-hand part of FIG. 11*a* which cut is designated the reference numeral 21. Basically, the tenth embodiment 10$^{x}$ is used in the same manner as the above described embodiments illustrated in FIGS. 1*a*, 1*b* through 10*a*, 10*b*.

Figures 12A, 12B:
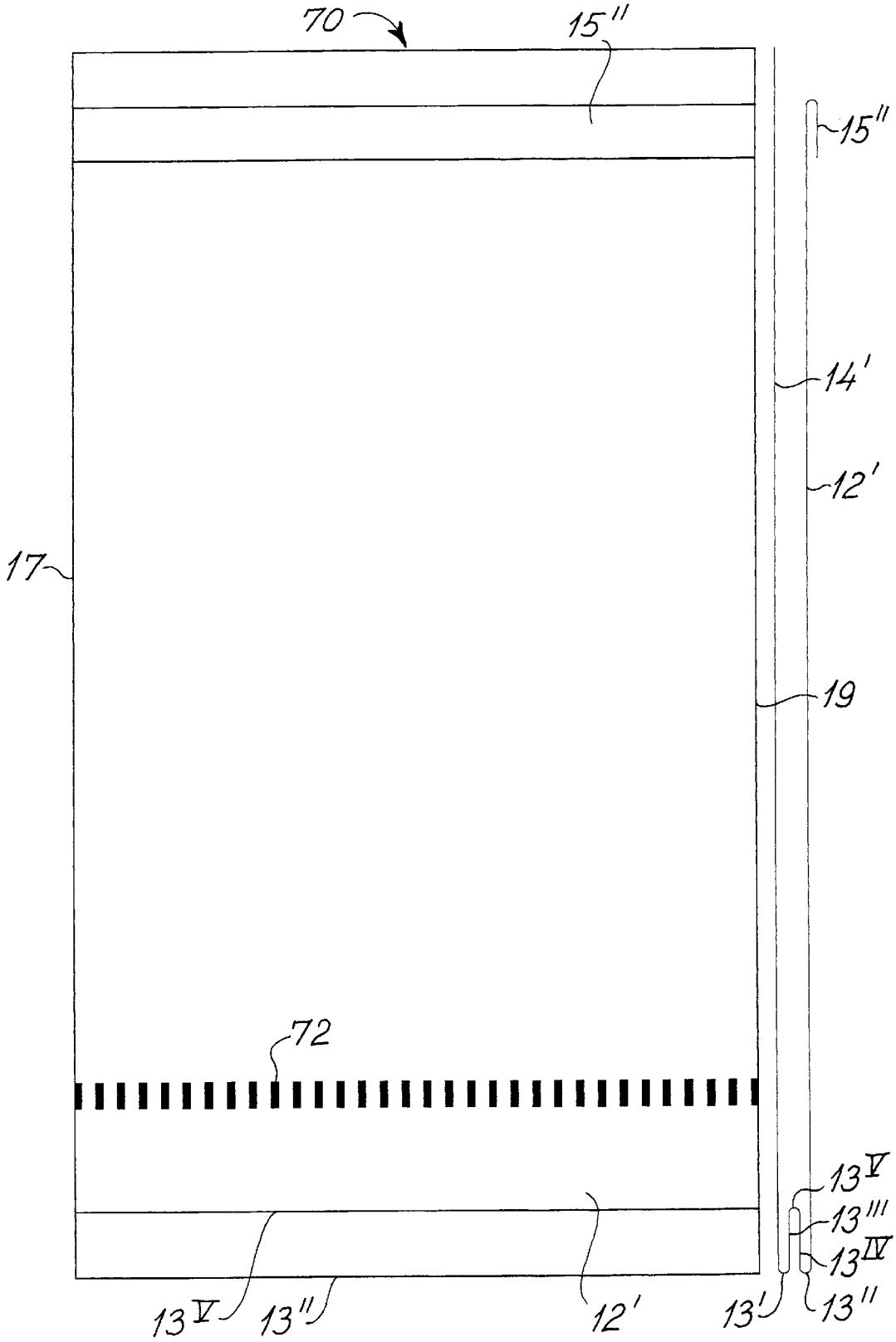
FIG. 12*a* is a view similar to the views of FIGS. 1*a*, 2*a*, 3*a*, 4*a*, 5*a*, 6*a*, 9*a*, 10*a*, and 11*a* of an eleventh embodiment of the multipurpose bag according to the present invention constituting a disposable bag.

In FIGS. 12*a* and 12*b*, a further or eleventh embodiment of the bag 70 according to the present invention is shown constituting a completely different concept as compared to the above described separation and draining bags. The bag 70 is made from a continuous web similar to the web illustrated in FIG. 9 and comprising a front and rear foil 12' and 14', respectively, a turned-over flap 15' of the front foil 12' at the top of the bag and a folded bottom part including the inner folded foils 13'" and 13$^{iv}$ along with the foil parts 13', 13" and 13$^{v}$. Along the edges of the foil, the bag is sealed by means of continuous side joints 17 and 19. At the bottom part of the bag, a plurality of vertically positioned linear weld seam segments 72 are provided constituting a transversal band of separator elements separating the bag into the inner chamber positioned above the individual weld seam segments 72 for receiving the product to be rinsed and a collector chamber below the weld seam segments 72. The spacing between the individual weld seam segments 72 allows water to be drained from the inner chamber of the bag into the collector chamber of the bag, still it is contemplated that the spacing between the individual linear weld seams 72 may establish a unidirectional venting feature as the spacing may accomplish a sealing off of the lower collector chamber from the inner chamber of the bag up to a specific water pressure which may be established within the inner chamber of the bag.

Consequently, the water contained within the bag may only be drained from the inner chamber into the collector chamber through the exposure of the water to a force impact exceeding the gravitational force which force impact is readily produced by swinging the bag rapidly around thereby in the centrifugal force system established providing a force impact to the water contained within the inner chamber of the bag exceeding the water level barrier ability of the band of weld seam segments 72. It is contemplated that similar force impact related separation features may be established in all the above described embodiments thereby preventing water from being drained from the inner chamber of the bag into the collector chamber of the bag until the bag is exposed to a centrifugal force exceeding the gravitational force.

Figure 13:
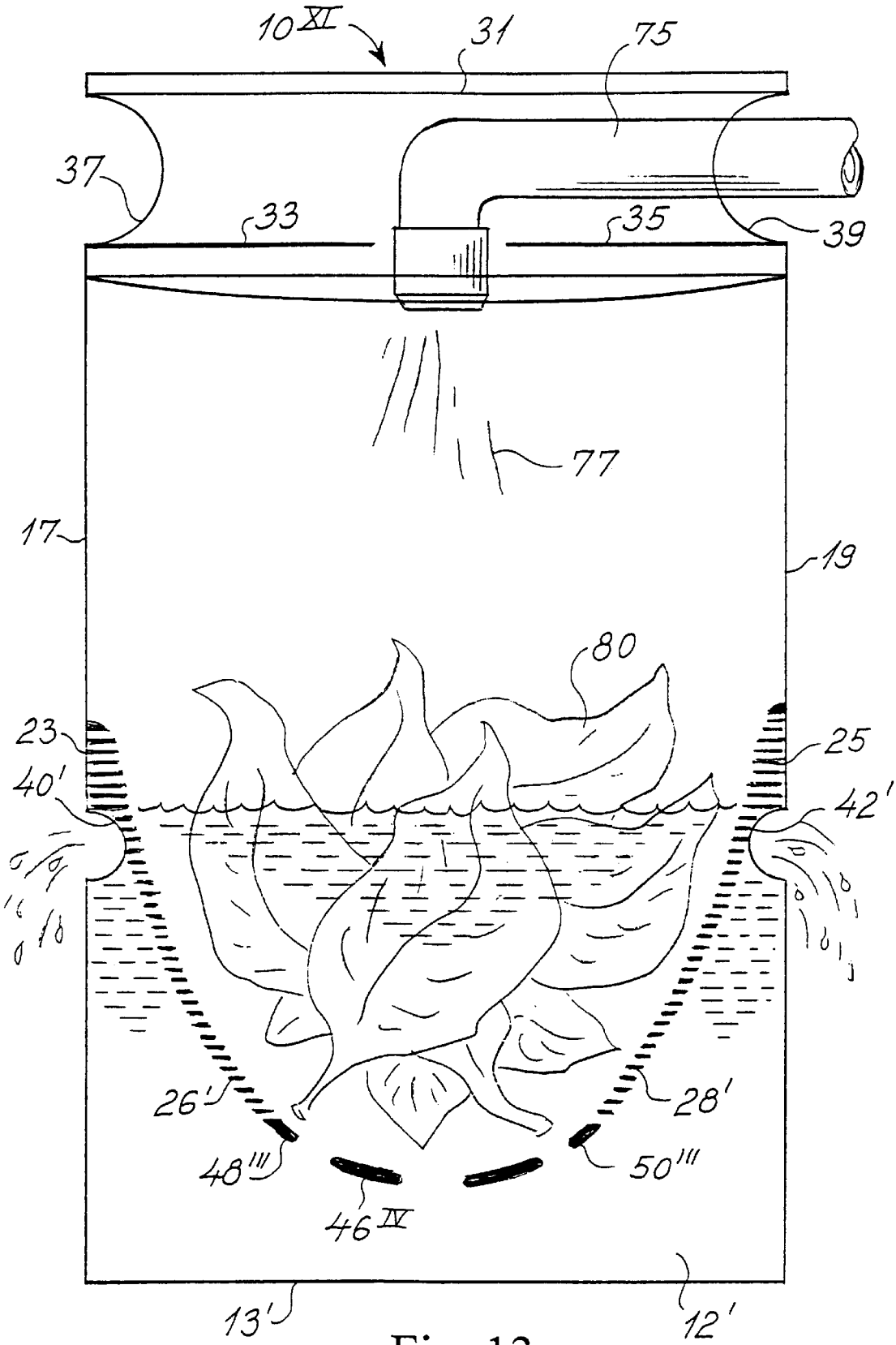
FIG. 13 is a schematic and perspective view illustrating a further embodiment constituting a modified version of the tenth embodiment illustrated in FIGS. 11*a* and 11*b* and further illustrating the utilization of the multipurpose bag according to the present invention.

In FIG. 13, a further embodiment 10$^{xi}$ of the bag according to the present invention is shown constituting a combination of the above described eighth embodiment illustrated in FIGS. 9*a* and 9*b* and the above described tenth embodiment illustrated in FIGS. 11*a* and 11*b* as the eighth embodiment is provided with the top closure of the tenth embodiment allowing the bag 10$^{xi}$ to be mounted on a water tap 75 for pouring water into the inner chamber of the bag as indicated by the reference numeral 77 in which inner chamber a number of salad leaves 80 are received. As the water is rising within the inner chamber to a level adjacent the semi-circular openings or cuts 40' and 42', water is expelled from the bag thereby establishing a flow of water through the bag in the operation of rinsing the salad leaves 80.

Figure 14:
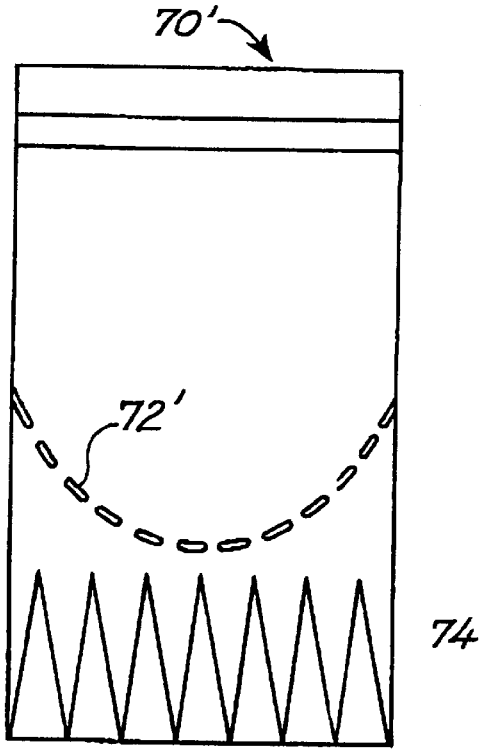
FIG. 14 is a plan, schematic view of a twelfth embodiment of the multipurpose bag according to the present invention.

In FIGS. 14–17, specific additional features of alternative embodiments of the bag according to the present invention are shown. In FIG. 14, the bag designated the reference numeral 70' includes a set of weld seams 72' separating the inner of the bag into an inner chamber for receiving the product to be rinsed or stored within the bag and a collector chamber below the inner chamber. For establishing a two-step sieve or strainer structure, a zig-zag bottom weld seam 74 is provided. By cutting the bottom end of the bag at a specific level above the bottom edge of the bag, a specific opening area of the bottom part of the bag may be established through the zig-zag weld seam 74. Consequently, provided the cut is established at a level just above the bottom edge of the bag, the openings are as will be understood extremely small whereas provided the cut is established at the top of the zig-zag weld seam 74, the openings will become very large.

Figure 15:
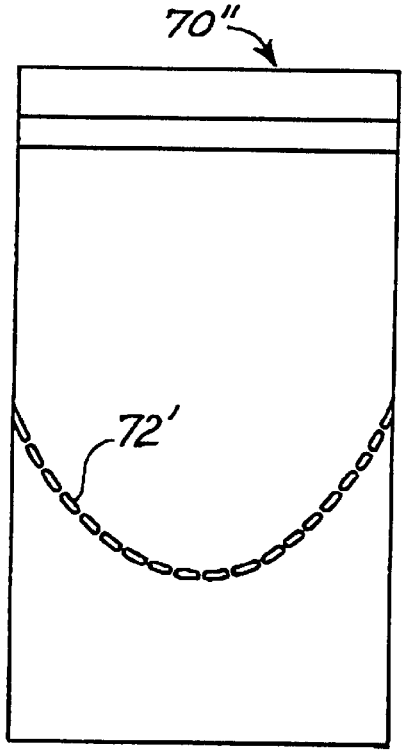
FIG. 15 is a view similar to the view of FIG. 14 of a thirteenth embodiment of the multipurpose bag according to the present invention.

In FIG. 15, the separation weld seams corresponding to the weld seams 72' illustrated in FIG. 14 are positioned at a fairly short distance providing the above described unidirectional end force impact related separation feature described above with reference to FIGS. 12*a* and 12*b*.

Figure 16:
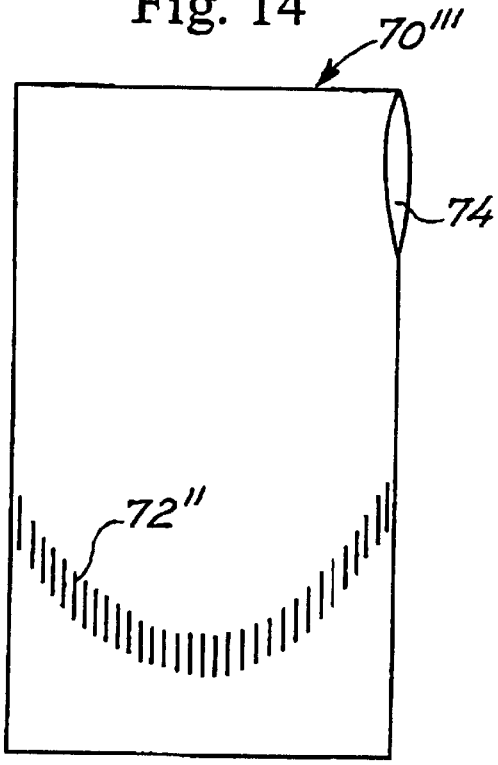
FIG. 16 is a schematic view similar to the views of FIGS. 14 and 15 of a fourteenth embodiment of the multipurpose bag according to the present invention.

In FIG. 16, a further feature relating to the technique of introducing water into the bag is illustrated as the bag is constituted by a bag which is sealed along the outer edges except for an upper corner opening 74 allowing the bag to be positioned on the water tap for fixating the bag 70'" on the water tap while water is poured into the interior of the bag. In FIG. 16, the separation weld seam set is established by means of vertical linear weld seams segments 72" serving the same purpose as the linear vertical weld seam segments 72 described above with reference to FIGS. 12*a* and 12*b*.

Figure 17:
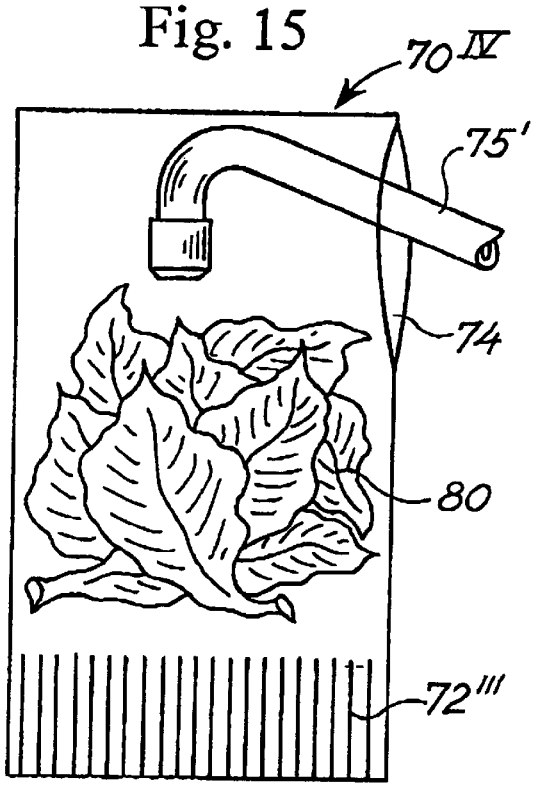
FIG. 17 is a schematic and perspective view of a fifteenth embodiment of the multipurpose bag according to the present invention and further the utilisation of the bag for rinsing a food stuff product.

In FIG. 17, the bag 70$^{vi\ is}$ positioned on the water tap 75' as described above with reference to FIG. 16 as the water tap is put through the opening 74 for allowing water to be poured onto the salad leaves 80 without spilling water from the bag. At the bottom of the bag 70$^{iv}$, a plurality of vertical linear weld seams 72''' are provided for establishing a sieve or strainer structure which of course in accordance with the teachings of the present invention may be modified through the provision of a bottom end collector chamber as described above with reference to FIGS. 1*a*, 1*b* through 11*a*, 11*b* and 13.

Figures 18A, 18B:
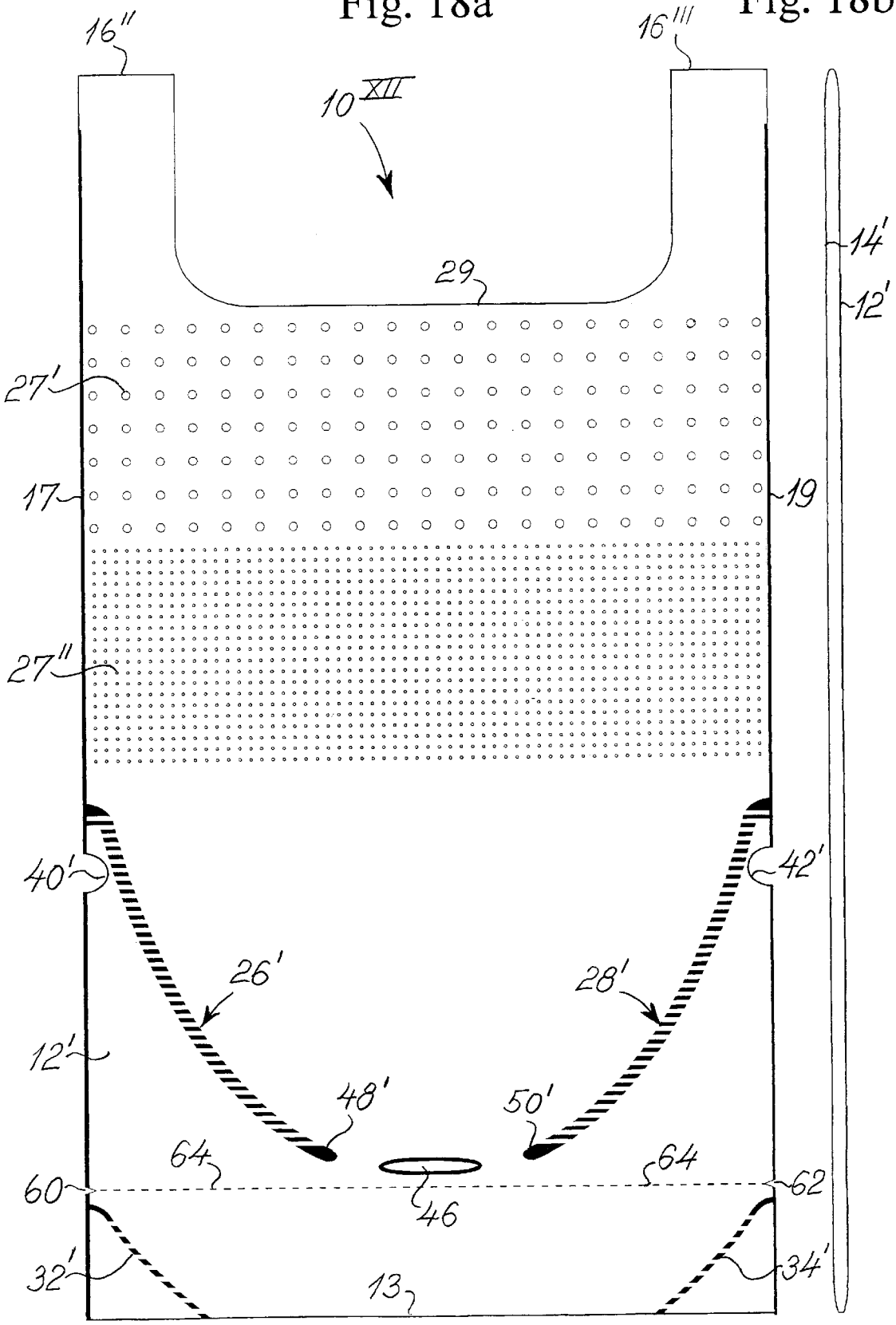
FIG. 18*a* is a schematic and perspective view of a sixteenth embodiment of the multipurpse bag according to the present invention.
FIG. 18*b* is a side view of the sixteenth embodiment.

In FIGS. 18*a* and 18*b*, a sixteenth embodiment 10$^{xii}$ of the multipurpose bag according to the present invention is shown which bag is of a configuration corresponding to the above described third embodiment 10$^{ii}$ illustrated in FIGS. 3*a* and 3*b*, however modified through the provision of two sets of microperforations or holes, a first set being designated the reference numeral 27' and a second set being designated the reference numeral 27''. The first set is positioned at the top part of the bag and includes a plurality of individual holes of a circular configuration and having a diameter of the order of 1–5 mm, the individual holes being positioned in a square pattern and being established in both foils 12' and 14' of the bag. Below the first set of holes 27', a second set 27'' is provided being constituted by a plurality of microperforations i.e. perforations having a diameter of less than 1 mm each.

Figure 19:
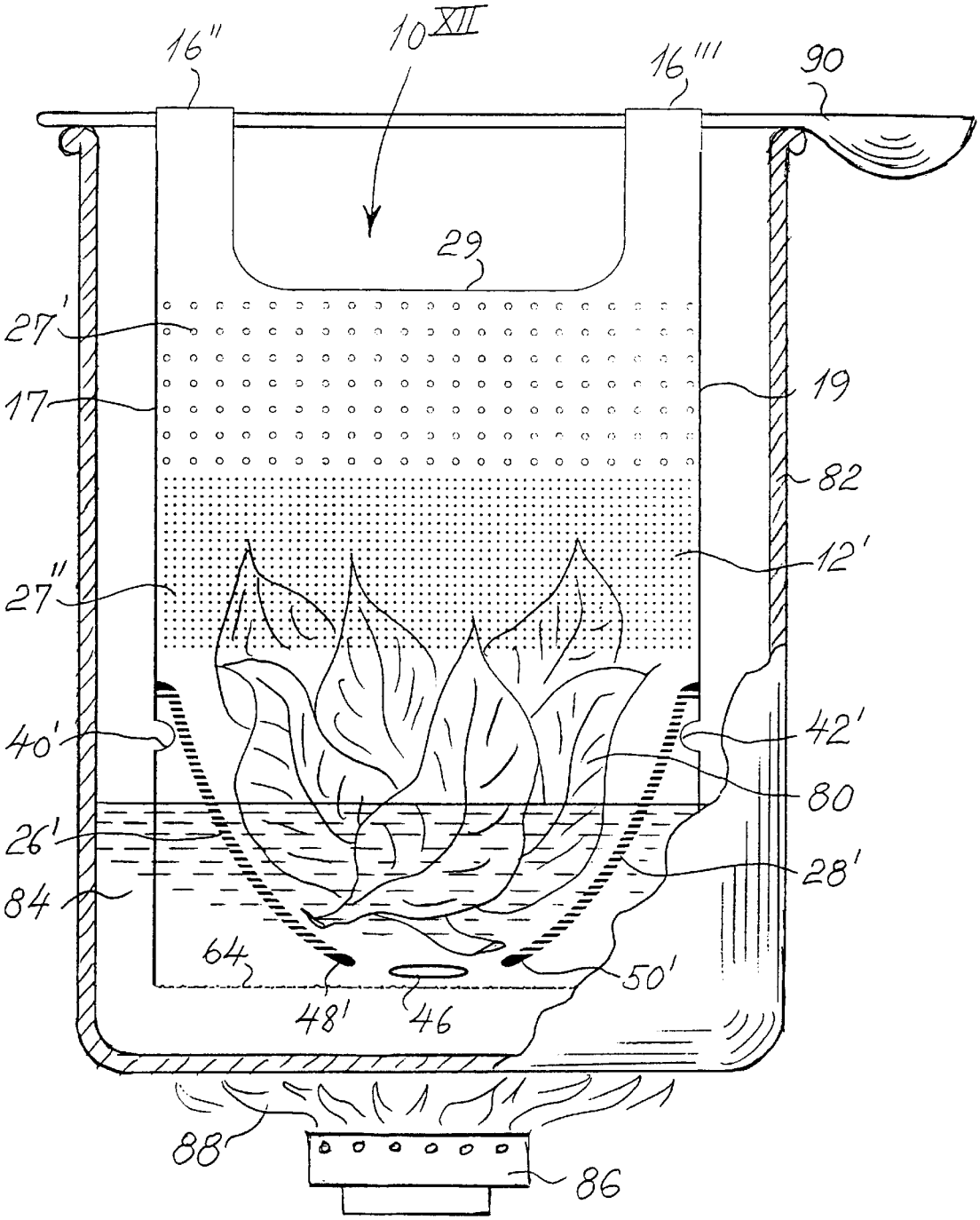
FIG. 19 is a schematic and perspective view illustrating the sixteenth embodiment of the multipurpose bag according to the present invention illustrated in FIGS. 18*a* and 18*b* for the preparation of a product contained within the multipurpose bag.

Apart from the provision of two sets of holes or microperforations at the top part of the bag, i.e. above the inwardly converging weld seam sets 26' and 28', the sixteenth embodiment 10$^{xii}$ is differing from the above described third embodiment in two further aspects, namely firstly in the provision of a top cut 29 establishing the top opening of the bag and at the same time establishing two hanging eyelets 26'' and 26''' which eyelets may be used in a rinsing operation as is illustrated in FIG. 13 and further used in a blanching or cooking operation as will be described in greater details below with reference to FIG. 19.

Further the sixteenth embodiment 10$^{xii}$ of the multipurpose bag according to the present invention illustrated in FIGS. 18*a* and 18*b*, differs from the above described third embodiment 10$^{ii}$ in that the multipurpose bag 10$^{xii}$ is provided with the cuts 60 and 62 described above with reference to FIG. 4*c* and the weakening spots or areas 64 also described above with reference to FIG. $\mathbf{4}_c$ allowing the bottom part of the bag to be torn off or separated from the remaining to part of the bag thereby converging the bag into a sieve/strainer structure or into a bag for hanging within a container such as a pot as is illustrated in FIG. 19.

In FIG. 19, the sixteenth embodiment 10$^{xii}$ of the multipurpose bag according to the present invention is illustrated used for a further intentional purpose namely the purpose of preparing a product such as vegetable leaves 80 contained within the bag which leaves are boiled while the bag is hung within a pot 82 which is heated by means of a gas burner 86 generating flames which cause the content of the pot including a volume of water 84 to be heated to an elevated temperature thereby blanching or cooking the vegetable leaves 80.

The leaves are maintained within the bag 10$^{xii}$ after the bottom part has been torn off or separated from the remaining part of the bag or alternatively without having the bottom part separated from the bag as the bag is simply hung within the pot in an upright position by utilising the eyelets 16'' and 16''' as hanging eyelets through which a spoon 90 or similar pin or alternatively any other elongated instrument is introduced straddling the top of the pot.

In FIG. 19, the vegetable leaves 80 are blanched while heat is generated by means of the gas burner 86, alternatively the product may provided a heat stable plastic material be utilised be exposed to a frying operation, a microwave heating in a microwave oven etc. Provided the bag is used within a microwave oven, the bag is preferably further used for the purpose of allowing liquid such as water or fatty substances expelled from the product being exposed to the microwave radiation to be collected within the bottom part of the bag which liquid being water or a fatty substance is thereupon easily expelled from the bag by manipulating the bag in the same tilting operation as described above for the purpose of rinsing the product contained within the bag.

It is further to be realised that a modified version of the multipurpose bag may be provided in which a further outer wall or sheet be included serving the purpose of closing off the one side of the bag as the bag may be positioned lying on a supporting surface e.g. a dish or tray within an oven as the one or more outer sheets or walls may serve the purpose of establishing an outer enclosure within which the multipurpose bag is contained thereby allowing the multipurpose bag to be used for e.g. frying a meat product within a conventional convection or hot air oven or a combined microwave and conventional convection and/or hot air oven.

EXAMPLE

A prototype of the above described fourth embodiment excluding the central reinforcing weld seam set 47 was made from two-ply of 25 $\mu$m LDPE foil, the front and rear foils 12 and 14, respectively measuring 50 cm×30 cm. The individual weld seam segments of the weld seam sets 22', 24', 23, 25, 26', 28', 30', 32', 34', 36' and 38' had a width of 1 mm and was spaced a distance of 1 mm from the neighbour weld seam segment. The length of each of the weld seam segments of the weld seam sets 22', 24', 26', 28', 30', 36' and 38' was 5 mm. The elliptical weld seam 46' had a major axis of 8 mm and a minor axis of 5 mm.

The bag was tested for its intentional purpose and turned out to provide a correct function as the product being salad leaves contained within the inner chamber of the bag was easily washed and caused to be cleaned or rinsed whereas the water was easily transferred from the inner chamber to the separator chamber and from the separator chamber expelled through the openings 40'' and 42''.

Although the invention has been described above with reference to a number of specific and presently preferred embodiments, it is to be contemplated that the above described features of the individual embodiments may be combined in numerous ways and further be modified by incorporating features well known in the art per se from the technical field of foil bags without in any aspects deviating from the scope and spirit of the present invention as defined in the appending claims. In this context it is to be realised that the bag may be closed by means of the above described flaps or the above-mentioned zipper or alternatively by flaps or extensions of the bag allowing for the establishment of a knot for closing off the bag by tying together the flaps or the extensions by means of the knot.

What is claimed is:

1. A flexible multipurpose convenience bag for storing a product, such as a food product, and for allowing said product to be cleaned or rinsed by pouring water into said bag, said bag comprising:

two sheet-shaped foil layers having substantially identical geometrical configurations and arranged in substantially coplanar and coextensive relationship, said foil layers together defining an outer periphery including a top, a bottom and opposite sides, a first peripheral joint extending along said bottom, second peripheral joints extending along the major parts of said sides except for at least one area of one of said sides, said area dividing said second peripheral joint of said one side into a top part and a bottom part, said first peripheral joint and said second peripheral joints together define an inner chamber within said bag, at least one separation joint extending from said top part of said second peripheral joint of said one side and extending towards said first peripheral joint and dividing said inner chamber into a top chamber and a bottom chamber said top defining a top opening communicating with said top chamber said area of said one side defining a side opening communicating with said bottom chamber and said separation joint establishing a restriction of communication between said top chamber and said bottom chamber for preventing said product when received within said top chamber from being transferred to said bottom chamber so as to allow said product received within said top chamber to be separated from liquid contained within said top chamber or supplied to said top chamber through said top opening and allowing said liquid to be expelled from said top chamber into said bottom chamber through said restriction of communication between said top chamber and said bottom chamber and further allowing said liquid to be expelled from said bottom chamber through said side opening.

2. The flexible multipurpose convenience bag according to claim 1, said bag being of a substantially symmetrical configuration having two separation joints extending from said second peripheral joints and converging towards one another for providing at least one opening between said two separation joints constituting said restriction of communication between said top and said bottom chamber.

3. The flexible multipurpose convenience bag according to claim 2, said bag having two side openings at respective sides of said bag.

4. The flexible multipurpose convenience bag according to claim 1, wherein said bag comprises two rectangular foils.

5. The flexible multipurpose convenience bag according to claim 1, wherein the bag comprises a single rectangular foil that is folded along a transverse fold for establishing said two sheet-shaped foil layers, and wherein said transverse fold defines said first peripheral joint.

6. The flexible multipurpose convenience bag according to claim 1, wherein said foil layers are made from a plastic material that is suitable for contact with foodstuff.

7. The flexible multipurpose convenience bag according to claim 1, wherein said bag has a maximum length between said top and bottom of between about 20–100 cm, and a maximum width of between about 10–60 cm.

8. The flexible multipurpose convenience bag according to claim 1, wherein said side opening is located at a position that is no more than about 70% of the distance above said bottom, and wherein said side opening defines not more than about 25% of the length of said side.

9. The flexible multipurpose convenience bag according to claim 1, wherein said side opening is established by an unjoined area of said two foil layers.

10. The flexible multipurpose convenience bag according to claim 1, wherein said first and second peripheral joints and said at least one separation joint are selected from the group consisting of weld seams, glued/adhered joints or combined welded and glued/adhered joints.

11. The flexible multipurpose convenience bag according to claim 10, wherein said peripheral joints and said at least one separation joint are weld seams selected from the group consisting of solid line weld seams, plural rectilinear parallel weld seam segments, and parallel rows of individual weld seams.

12. The flexible multipurpose convenience bag according to claim 1, further comprising means for the separation of a bottom part of said bag from the remaining part of said bag for converting said bottom chamber into an opening channel, converting said bag into a sieve or strainer structure.

13. The flexible multipurpose convenience bag according to claim 1, wherein at least one of said two foil layers comprises an extension at the top thereof for providing a turned-over flap for the closing off of said top opening.

14. The flexible multipurpose convenience bag according to claim 1, further comprising a joint within said bottom chamber constituting a guide for the guiding of water from said restriction of communication towards said side opening.

15. The flexible multipurpose convenience bag according to claim 1, wherein said separation joint defines a multiplicity of individual water transmission restrictions preventing the transmission of water from said top chamber to said bottom chamber unless the water contained within said top chamber is exposed to a force exceeding gravitational force.

16. The flexible multipurpose convenience bag according to claim 1, wherein at least one of said two sheet-shaped foil layers is provided with microperforations.

17. The flexible multipurpose convenience bag according to claim 16, wherein said microperforations are located above said at least one separation joint.

18. The flexible multipurpose convenience bag according to claim 1, wherein the side opening is formed by a cut through at least one of the foil layers.

19. A method of handling a foodstuff product, comprising:

providing a flexible multipurpose convenience bag according to claim 1;

placing a foodstuff product in the bag; and performing a task selected from the group consisting of rinsing the product contained within said bag, storing said product within said bag, and cooking said product contained within said bag.

* * * * *